US011498823B2

(12) United States Patent
Hayakawa

(10) Patent No.: US 11,498,823 B2
(45) Date of Patent: Nov. 15, 2022

(54) CARBONATED BEVERAGE ASEPTIC FILLING SYSTEM, BEVERAGE FILLING SYSTEM, AND CIP PROCESSING METHOD

(71) Applicant: Dai Nippon Printing Co., Ltd., Tokyo (JP)

(72) Inventor: Atsushi Hayakawa, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 17/251,268

(22) PCT Filed: Jun. 21, 2019

(86) PCT No.: PCT/JP2019/024663

§ 371 (c)(1),
(2) Date: Dec. 11, 2020

(87) PCT Pub. No.: WO2019/245019

PCT Pub. Date: Dec. 26, 2019

(65) Prior Publication Data

US 2021/0261397 A1 Aug. 26, 2021

(30) Foreign Application Priority Data

Jun. 21, 2018 (JP) ..... JP2018-117991
Apr. 26, 2019 (JP) ..... JP2019-086525

(51) Int. Cl.
*B67C 3/08* (2006.01)
*B67C 3/12* (2006.01)
*B67C 3/22* (2006.01)

(52) U.S. Cl.
CPC ..... *B67C 3/08* (2013.01); *B67C 3/12* (2013.01); *B67C 3/22* (2013.01); *B67C 2003/228* (2013.01)

(58) Field of Classification Search
CPC .... B67C 3/06; B67C 3/08; B67C 3/12; B67C 3/22; B67C 3/2625; B67C 2003/228
(Continued)

(56) References Cited

U.S. PATENT DOCUMENTS 5,139,058 A * 8/1992 Yun ..... B67C 3/2628 141/147
6,076,567 A * 6/2000 Naecker ..... B67C 3/2617 141/147

(Continued)

FOREIGN PATENT DOCUMENTS

EP 2 409 948 B2 1/2012
JP S61-014698 U 1/1986

(Continued)

OTHER PUBLICATIONS

English translation of the International Preliminary Report on Patentability (Chapter I) (Application No. PCT/JP2019/024663) dated Dec. 30, 2020.

(Continued)

*Primary Examiner* — Timothy L Maust
(74) *Attorney, Agent, or Firm* — Burr & Brown, PLLC

(57) ABSTRACT

A carbonated beverage aseptic filling system (10) comprises: a filling nozzle (72) for filling a carbonated beverage; a carbonated beverage filling tank (75) connected to the filling nozzle (72) via a carbonated beverage supplying pipe (73) and a counter pressure pipe (74); a snift pipe (78) connected to the filling nozzle; and an aseptic chamber (13) enclosing the filling nozzle (72), at least part of the carbonated beverage supplying pipe (73), and at least part of the counter pressure pipe (74). The carbonated beverage supplying pipe (73) and the counter pressure pipe (74) are attached to the aseptic chamber (13) by a rotary joint (77). A discharging valve (79) is provided in the snift pipe (78) inside the aseptic (Continued)

chamber (13), and gas from the snift pipe (78) is discharged into the aseptic chamber.

5 Claims, 10 Drawing Sheets

(58) Field of Classification Search
USPC ..... 141/57, 144–148
See application file for complete search history.

(56) References Cited

U.S. PATENT DOCUMENTS

| | | | | |
|---|---|---|---|---|
| 6,817,386 | B2 * | 11/2004 | Tsukano | B67C 3/281 141/54 |
| 7,299,833 | B2 * | 11/2007 | Ruble | B67C 3/281 141/144 |
| 7,464,732 | B2 * | 12/2008 | Nishino | B67C 3/04 141/144 |
| 7,469,726 | B2 * | 12/2008 | Clusserath | B67C 3/12 141/147 |
| 8,109,299 | B2 * | 2/2012 | Lupi | B67C 3/2625 141/144 |
| 8,844,585 | B2 | 9/2014 | Laumer et al. | |
| 10,293,540 | B2 | 5/2019 | Hayakawa et al. | |
| 10,442,669 | B2 | 10/2019 | Hayakawa et al. | |
| 10,479,668 | B2 * | 11/2019 | Bulunmaz | B67C 3/06 |
| 2005/0098230 | A1 * | 5/2005 | Stavrakis | B67C 3/26 141/144 |
| 2015/0298178 | A1 | 10/2015 | Hayakawa | |
| 2016/0046475 | A1 | 2/2016 | Hayakawa et al. | |
| 2019/0375622 | A1 | 12/2019 | Hayakawa | |
| 2019/0389710 | A1 | 12/2019 | Hayakawa et al. | |
| 2021/0261397 | A1 * | 8/2021 | Hayakawa | B67C 7/0073 |

FOREIGN PATENT DOCUMENTS

| | | | |
|---|---|---|---|
| JP | H05-254596 | A | 10/1993 |
| JP | H09-216693 | A | 8/1997 |
| JP | 2000-109188 | A | 4/2000 |
| JP | 2004-018044 | A1 | 1/2004 |
| JP | 2004-315045 | A | 11/2004 |
| JP | 2005-014918 | A1 | 1/2005 |
| JP | 2007-302325 | A1 | 11/2007 |
| JP | 2008-105699 | A1 | 5/2008 |
| JP | 2010-042833 | A | 2/2010 |
| JP | 4674743 | B2 | 4/2011 |
| JP | 2014-189328 | A1 | 10/2014 |
| JP | 2016-094250 | A1 | 5/2016 |
| JP | 2017-222415 | A | 12/2017 |
| JP | 2018-012548 | A | 1/2018 |
| JP | 2018-052612 | A1 | 4/2018 |
| JP | 2018-052623 | A1 | 4/2018 |
| JP | 2018-122915 | A1 | 8/2018 |
| WO | 2015/072505 | A1 | 5/2015 |
| WO | 2018/062311 | A1 | 4/2018 |

OTHER PUBLICATIONS

International Search Report and Written Opinion (Application No. PCT/JP2019/024663) dated Sep. 17, 2019.
Japanese Office Action (Application No. 2018-117991) dated Sep. 3, 2019 (with English translation).
Japanese Office Action (Application No. 2019-086525) dated Jun. 23, 2020 (with English translation).
Japanese Office Action (Application No. 2019-216751) dated Dec. 1, 2020 (with English translation).
Japanese Office Action (Application No. 2021-045105) dated Dec. 3, 2021 (with English translation).
Japanese Office Action (with English translation), Japanese Application No. 2021-033808, dated Apr. 1, 2022 (7 pages).
Japanese Office Action (with English translation), Japanese Application No. 2021-033815, dated Apr. 1, 2022 (9 pages).
European Search Report, European Application No. 19822916.3, dated Sep. 15, 2022 (13 pages).

* cited by examiner

CARBONATED BEVERAGE ASEPTIC FILLING SYSTEM, BEVERAGE FILLING SYSTEM, AND CIP PROCESSING METHOD

TECHNICAL FIELD

The present disclosure relates to a carbonated beverage aseptic filling system, a beverage filling system, and a CIP processing method.

BACKGROUND ART

Conventionally, a filling machine such as a filler provided in a carbonated beverage aseptic filling apparatus has been used to continuously and aseptically fill a large number of plastic bottles transported at high speed with content such as carbonated beverage.

In such a carbonated beverage aseptic filling apparatus, a filling nozzle for filling a plastic bottle with carbonated beverage is disposed rotatably inside an aseptic chamber. Therefore, each of a carbonated beverage supplying pipe, a pipe for counter gas, and a pipe for snifting, etc. to be connected to the filling nozzle is attached to an aseptic chamber by means of a rotary joint (see for example Patent Literature 1).

However, the rotary joint has a complicated structure and therefore a configuration of the carbonated beverage aseptic filling apparatus is likely to be complicated. Further, the rotary joint is expensive and therefore, if a large number of rotary joints are provided, the carbonated beverage aseptic filling apparatus is likely to be expensive.

CITATION LIST

Patent Literature

Patent Literature 1: JP 2007-302325 A
Patent Literature 2: JP 2008-105699 A
Patent Literature 3: JP 2005-14918 A The present disclosure is achieved with the above matter taken into consideration, thereby providing a carbonated beverage aseptic filling system whose entire system can be simplified by reducing the number of rotary joints.

Recently, there has been a beverage filling system that serves both carbonated beverages and non-carbonated beverages. In such a beverage filling system, some users rarely fill carbonated beverages and often fill non-carbonated beverages in a certain case. In this case, generally, it is also normal to perform CIP processing every time on a path used only at the time of filling carbonated beverages. Therefore, it takes longer to perform the CIP processing in the beverage filling system serving both carbonated and non-carbonated beverages than in the filling system exclusively for non-carbonated beverages, resulting in lowered productivity and loss of energy.

The present disclosure is achieved with the above matter taken into consideration and provides a beverage filling system and a CIP processing method that can shorten the CIP processing time in a beverage filling system serving both carbonated and non-carbonated beverages.

SUMMARY OF INVENTION

A carbonated beverage aseptic filling system according to one embodiment comprises: a filling nozzle for filling a carbonated beverage; a carbonated beverage filling tank connected to the filling nozzle via a carbonated beverage supplying pipe and a counter pressure pipe; a snift pipe connected to the filling nozzle; and an aseptic chamber enclosing the filling nozzle, at least part of the carbonated beverage supplying pipe and at least part of the counter pressure pipe, wherein the carbonated beverage supplying pipe and the counter pressure pipe are attached to the aseptic chamber by a rotary joint, a discharging valve is provided in the snift pipe inside the aseptic chamber, and gas from the snift pipe is discharged into the aseptic chamber.

In the carbonated beverage aseptic filling system according to one embodiment, the snift pipe has a rotation-type interior snift pipe located inside the aseptic chamber and rotates together with the filling nozzle, as well as an exterior snift pipe extending outward from the aseptic chamber and being of a non-rotation type. The discharging valve may be located between the interior snift pipe and the exterior snift pipe.

In the carbonated beverage aseptic filling system according to one embodiment, the exterior snift pipe may be stretchable.

In the carbonated beverage aseptic filling system according to one embodiment, it may also be possible to connect a carbon dioxide gas supplying pipe and a carbon dioxide gas discharging pipe to the carbonated beverage filling tank, to respectively provide valves to the carbon dioxide gas supplying pipe and the carbon dioxide gas discharging pipe, and to control each of the valves by a control part, thereby controlling pressure inside the carbonated beverage filling tank.

In the carbonated beverage aseptic filling system according to one embodiment, a relation $P1>P2$ may be established between a pressure P1 inside the carbonated beverage filling tank and a pressure P2 inside the carbon dioxide gas discharging pipe.

In the carbonated beverage aseptic filling system according to one embodiment, it may also be possible to respectively control the valves provided in the carbon dioxide gas supplying pipe and the carbon dioxide gas discharging pipe, lest the pressure P1 inside the carbonated beverage filling tank should be 0.01 MPa or lower.

According to the present disclosure, the entire configuration of the carbonated beverage aseptic filling system can be simplified by reducing the number of rotary joints.

The carbonated beverage aseptic filling system according to one embodiment is a beverage filling system serving both carbonated beverages and non-carbonated beverages, said system comprising: a carbonated beverage exclusive flow path used only for filling the carbonated beverages; a carbonated/non-carbonated beverage flow path used for filling both the carbonated beverages and the non-carbonated beverages; and a control part for controlling the beverage filling system, wherein the control part performs CIP cleaning on both the carbonated beverage exclusive flow path and the carbonated/non-carbonated beverage flow path if the beverage filled in bottles immediately before the CIP cleaning is a carbonated beverage, and performs the CIP cleaning on only the carbonated/non-carbonated beverage flow path if the beverage filled in the bottles immediately before the CIP cleaning is a non-carbonated beverage.

The beverage aseptic filling system according to one embodiment further comprises: a filling nozzle for filling the carbonated beverages or the non-carbonated beverages; a beverage filling tank connected to the filling nozzle via a beverage supplying pipe and a counter pressure pipe; and a snift pipe connected to the filling nozzle, wherein the carbonated beverage exclusive flow path may include the counter pressure pipe and the snift pipe, and the carbonated/ non-carbonated beverage flow path may include the filling nozzle and the beverage filling tank.

In the beverage aseptic filling system according to one embodiment, the control part may let steam flow through the carbonated beverage exclusive flow path after the CIP cleaning, thereby simultaneously sterilizing and cleaning the fluid-contacting portions of the carbonated/non-carbonated beverage flow path.

The CIP processing method according to one embodiment is a CIP processing method for performing the CIP processing on a beverage filling system serving both carbonated beverages and non-carbonated beverages, said beverage filling system comprising: a carbonated beverage exclusive flow path used only for filling the carbonated beverages; and a carbonated/non-carbonated beverage flow path used for filling both the carbonated beverages and the non-carbonated beverages, where said CIP processing method comprises the steps of: determining whether a beverage filled in bottles immediately before the CIP cleaning is the carbonated beverage or the non-carbonated beverage; selecting a flow path to be CIP-cleaned depending on the beverage filled in the bottles immediately before the CIP cleaning; and CIP-cleaning the selected flow path, wherein the CIP cleaning is performed on both the carbonated beverage exclusive flow path and the carbonated/non-carbonated beverage flow path if a beverage filled in bottles immediately before the CIP cleaning is a carbonated beverage, and the CIP cleaning is performed on only the carbonated/non-carbonated beverage flow path if a beverage filled in the bottles immediately before the CIP cleaning is a non-carbonated beverage.

According to the present disclosure, the CIP processing time can be shortened in a beverage filling system serving both carbonated beverages and non-carbonated beverages.

DESCRIPTION OF EMBODIMENTS

First Embodiment

Figure 1:
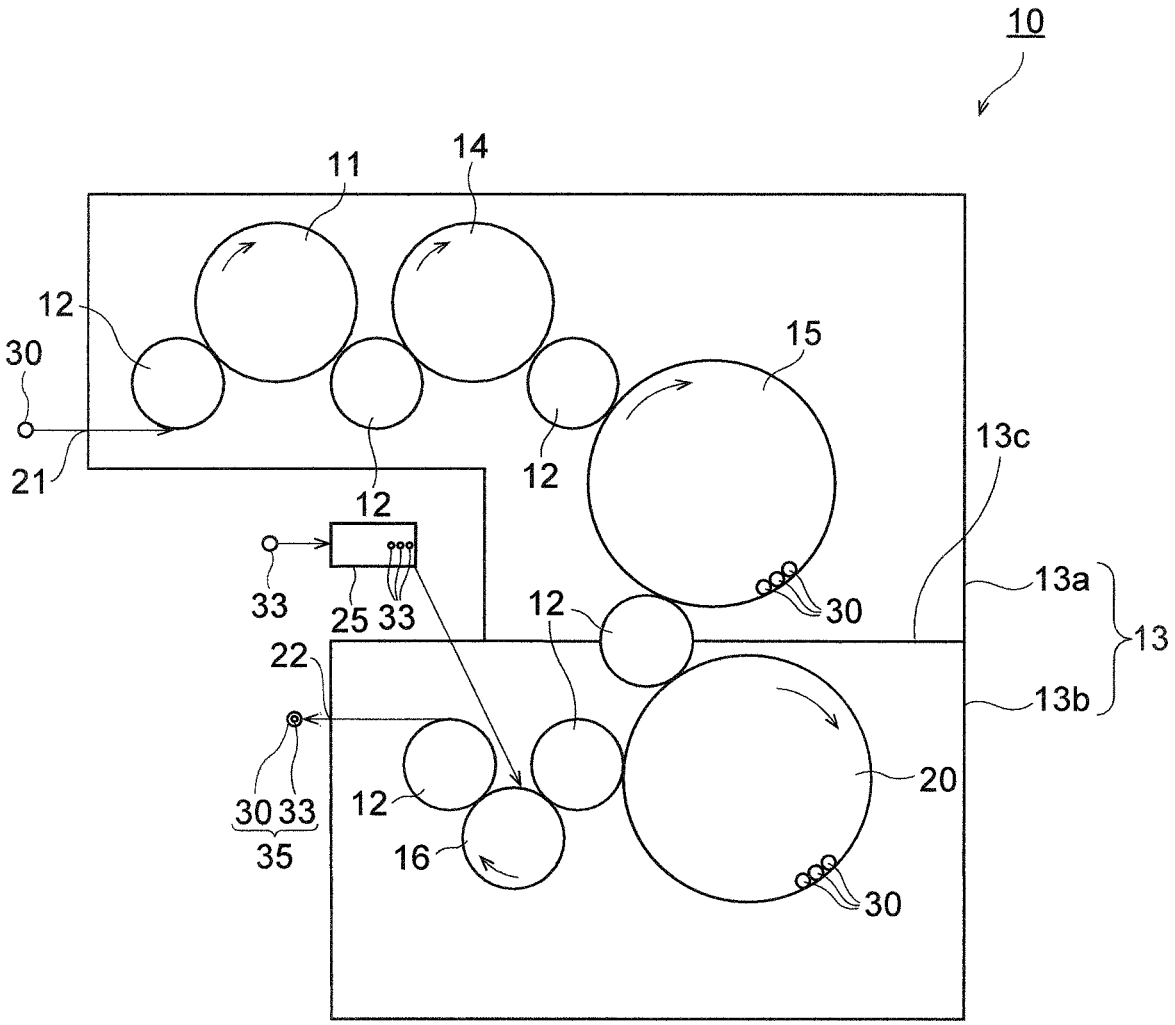
FIG. 1 is a schematic planar view showing a carbonated beverage aseptic filling system according to a first embodiment.
Figure 2:
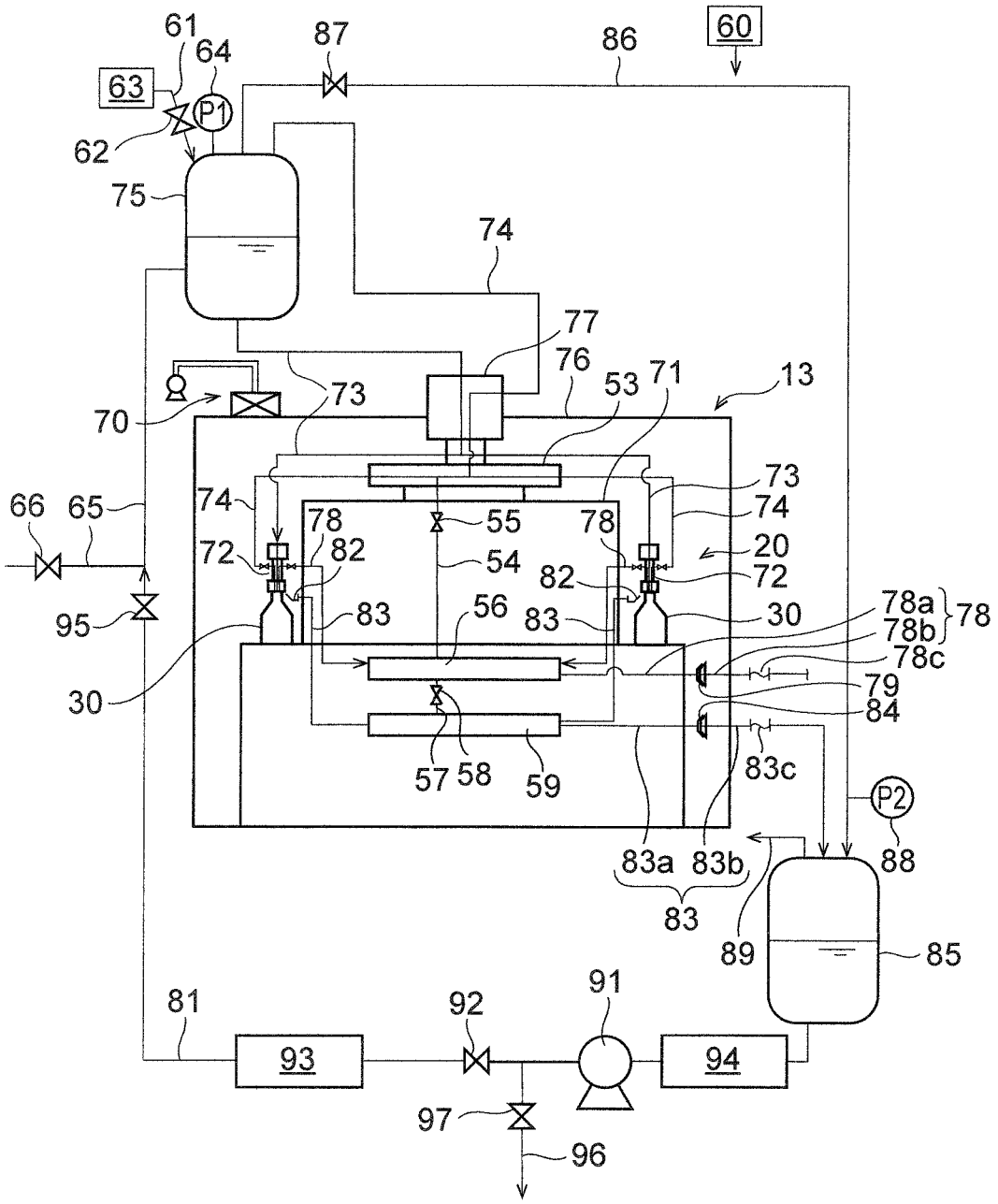
FIG. 2 is a schematic view showing a carbonated beverage filling part and a flow of fluid in its periphery of a carbonated beverage aseptic filling system according to a first embodiment.
Figure 3:
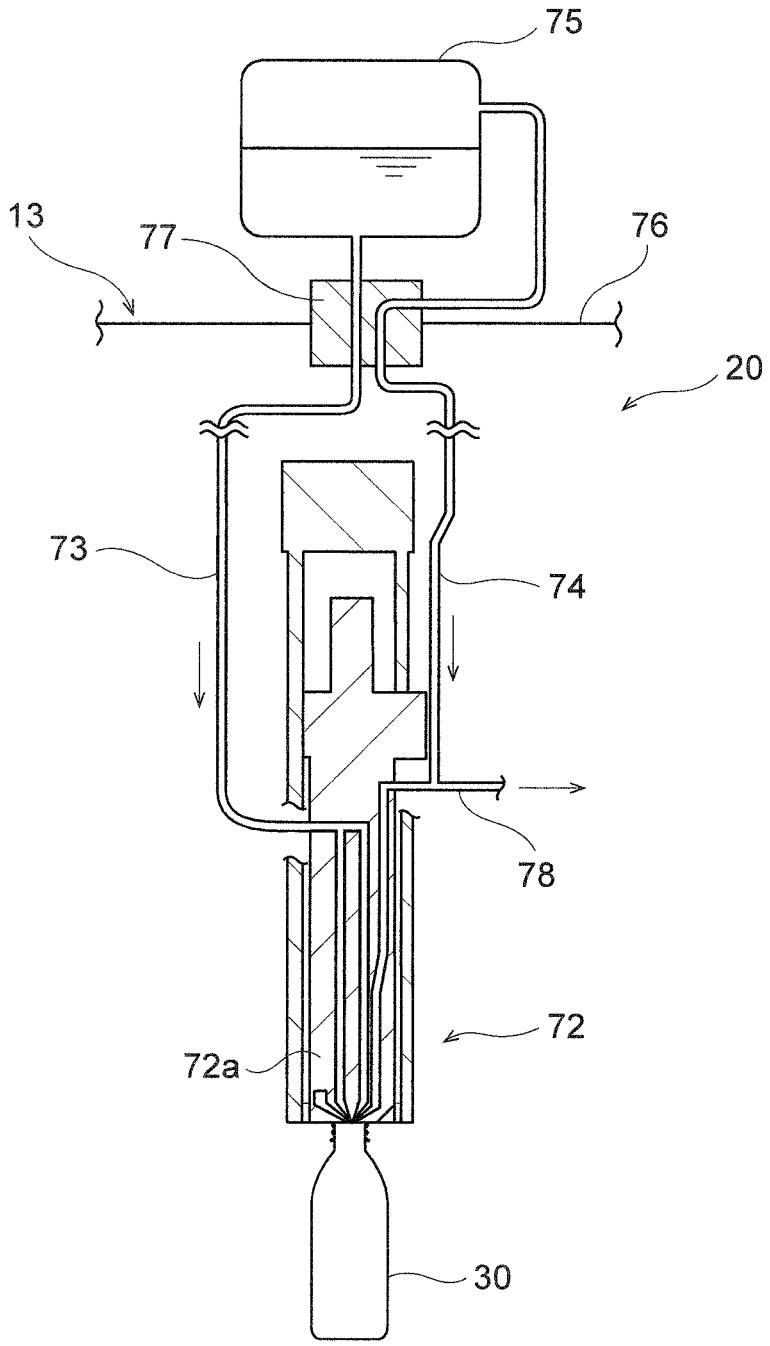
FIG. 3 is a schematic sectional view showing a filling nozzle of a carbonated beverage filling part of a carbonated beverage aseptic filling system according to a first embodiment.

Hereinafter, a first embodiment will be explained by referring to FIGS. 1 to 3. FIGS. 1 to 3 show the first embodiment. In the respective drawings mentioned below, the same numerals are given to the same parts and the detailed explanation will be partially omitted in some cases.

Carbonated Beverage Aseptic Filling System

First, the entire carbonated beverage aseptic filling system according to the present embodiment will be explained by referring to FIG. 1.

A carbonated beverage aseptic filling system 10 shown in FIG. 1 is a system for filling a bottle (container) 30 with contents composed of an aseptic carbonated beverage. The bottle 30 can be fabricated by performing biaxial stretching blow molding on a preform fabricated by injection-molding a synthetic resin material. As the material for the bottle 30, thermoplastic resins, particularly, PE (polyethylene), PP (polypropylene), PET (polyethylene terephthalate) or PEN (polyethylene naphthalate) are preferably used. Moreover, the container may be a glass bottle or a can, etc. that can be filled with a carbonated beverage. In the present embodiment, an explanation will be made by referring to, as an example, the case of using a plastic bottle as the container.

As shown in FIG. 1, the carbonated beverage aseptic filling system 10 comprises a bottle supplying part 21, a bottle sterilizing part 11, an air rinsing part 14, an aseptic water rising part 15, a carbonated beverage filling part (filler) 20, a cap fitting part (capper, seaming and capping machine) 16, and a product bottle carry-out part 22. The bottle supplying part 21, bottle sterilizing part 11, air rinsing part 14, aseptic water rinsing part 15, carbonated beverage filling part 20, cap fitting part 16, and product bottle carry-out part 22 are arranged in this order along a conveying direction of the bottle 30 from an upstream side to a downstream side. A plurality of conveying wheels 12 for conveying the bottle 30 are provided in between the bottle sterilizing part 11, the air rinsing part 14, the aseptic water rinsing part 15, the carbonated beverage filling part 20, and the cap fitting part 16.

The bottle supplying part 21 successively receives the empty bottles 30 from the outside into the carbonated beverage aseptic filling system 10 and conveys the received bottles 30 toward the bottle sterilizing part 11.

A (non-illustrated) molding part for molding the bottle 30 by biaxial stretching blow molding of the preform may be provided on the upstream side of the bottle supplying part 21. As described above, the process from supplying the preform and molding the bottle 30 to filling the bottle 30 with the aseptic carbonated beverage and capping the bottle 30 may be continuously carried out. In this case, not the bottle 30 with the large volume but the preform with the small volume can be conveyed from the outside to the carbonated beverage aseptic filling system 10, and therefore the facilities constituting the carbonated beverage aseptic filling system 10 can be made compact.

The bottle sterilizing part 11 sprays a sterilant into the bottle 30 to sterilize the inside of the bottle 30. As the sterilant, for example, a hydrogen peroxide solution is used.

In the bottle sterilizing part 11, the hydrogen peroxide solution with a concentration of at least 1 wt %, preferably 35 wt % is gasified once and thereafter condensed mist or gas is generated, so that this mist or gas is sprayed to the inner and outer surfaces of the bottle 30. As described above, the inside of the bottle 30 is sterilized by the mist or gas of the hydrogen peroxide solution, and therefore the inner surface of the bottle 30 is uniformly sterilized.

The air rinsing part 14 supplies, to the bottle 30, aseptic heated air or normal temperature air, thereby activating hydrogen peroxide and simultaneously removing foreign materials and hydrogen peroxide, etc. from the inside of the bottle 30.

The aseptic water rinsing part 15 washes the bottle 30 that has been sterilized by hydrogen peroxide as a sterilant by using aseptic water at 15° C. or higher and 85° C. or lower. Due to this, hydrogen peroxide adhering to the bottle 30 is washed down and the foreign materials are removed. The aseptic water rinsing part 15 does not necessarily provided.

The carbonated beverage filling part 20 fills the aseptic carbonated beverage that has been sterilized beforehand into the bottle 30 through an opening of the bottle 30. In this carbonated beverage filling part 20, the empty bottle 30 is filled with an aseptic carbonated beverage. In this carbonated beverage filling part 20, a plurality of bottles 30 rotate (revolve), while the bottles 30 are filled with aseptic carbonated beverage. The aseptic carbonated beverage is filled into the bottles 30 at a filling temperature of 1° C. or higher and 40° C. or lower, preferably 5° C. or higher and 10° C. or lower. As described above, the filling temperature of the aseptic carbonated beverage is set to e.g. 1° C. or higher and 10° C. or lower, because if the liquid temperature of the aseptic carbonated beverage exceeds 10° C., carbon dioxide easily escapes from the aseptic carbonated beverage. The aseptic carbonated beverages include various kinds of beverages containing carbon dioxide, for example, carbonated soft drinks such as cider and coke, as well as alcoholic drinks such as beer.

The bottle fitting part 16 caps the bottle 30 by fitting a cap 33 to the opening of the bottle 30. In the cap fitting part 16, the opening of the bottle 30 is closed by the cap 33 to hermetically seal the bottle 30, lest external air and germs should enter the bottle 30. In the cap fitting part 16, a plurality of bottles 30 having an aseptic carbonated beverage filled therein rotate (revolve), while the caps 33 are fitted to the openings. As described above, the cap 33 is fitted to the opening of the bottle 30, so that a product bottle 35 can be obtained.

The cap 33 is sterilized beforehand in a cap sterilizing part 25. The cap sterilizing part 25 is arranged for example outside a (below-mentioned) aseptic chamber 13 and in the vicinity of the cap fitting part 16. In the cap sterilizing part 25, a large number of the caps 33 conveyed from the outside are collected beforehand and conveyed in a line toward the cap fitting part 16. While the cap 33 is moving toward the cap fitting part 16, a mist or gas of hydrogen peroxide is sprayed to the inner and outer surface of the cap 33, which is dried by hot air and sterilized.

The product bottle carry-out part 22 continuously carries out the product bottle 35 with the cap 33 fitted thereon in the cap fitting part 16 to the outside of the carbonated beverage aseptic filling system 10.

The carbonated beverage aseptic filling system 10 also comprises an aseptic chamber 13. The bottle sterilizing part 11, the air rinsing part 14, the aseptic water rinsing part 15, the carbonated beverage filling part 20, and the cap fitting part 16, that are respectively described above, are housed inside the aseptic chamber 13. The interior of the aseptic chamber 13 is maintained in an aseptic state.

The aseptic chamber 13 is further sectioned into a bottle sterilizing chamber 13*a* and a filling/seaming chamber 13*b*. A chamber wall 13*c* is provided between the bottle sterilizing chamber 13*a* and the filling/seaming chamber 13*b*, so that the bottle sterilizing chamber 13*a* and the filling/seaming chamber 13*b* are separated from each other via the chamber wall 13*c*. Inside the bottle sterilizing chamber 13*a*, the bottle sterilizing part 11, the air rinsing part 14, and the aseptic water rinsing part 15 are arranged. Meanwhile, inside the filling/seaming chamber 13*b*, the carbonated beverage filling part 20 and the cap fitting part 16 are arranged.

Next, by referring to FIG. 2, the carbonated beverage filling part 20 of the carbonated beverage aseptic filling system 10 and its peripheral configuration will be explained.

As shown in FIG. 2, the carbonated beverage filling part 20 is provided inside the aseptic chamber 13. Further, outside the aseptic chamber 13 and above the carbonated beverage filling part 20, a carbonated beverage filling tank (filling head tank or buffer tank) 75 is disposed. The carbonated beverage filling tank 75 is filled with carbonated beverage. The carbonated beverage filling tank 75 is connected to an aseptic carbon dioxide supplying part 63 via a carbon dioxide gas supplying pipe 61. In the carbon dioxide gas supplying pipe 61, a first valve 62 is provided. By opening this first valve 62, carbon dioxide gas in an aseptic state is supplied from the aseptic carbon dioxide supplying part 63 to the carbonated beverage filling tank 75. An aseptic carbonated beverage inside the carbonated beverage filling tank 75 is pressurized by this aseptic carbonate gas, thereby preventing the carbon dioxide gas dissolved in the aseptic carbonated beverage from being discharged into a gas phase. Preferably, it is better to pressurize the aseptic carbonated beverage with a pressure higher than the carbon dioxide gas pressure under a production standard. Due to this, the concentration of the carbon dioxide gas in the carbonated beverage inside the carbonated beverage filling tank 75 is kept constant. A pressure P1 inside the carbonated beverage filling tank 75 is measured by a first pressure gauge 64 provided in the carbonated beverage filling tank 75.

To the carbonated beverage filling tank 75, a carbonated beverage introduction pipe 65 is connected. This carbonated beverage introduction pipe 65 is connected to a non-illustrated carbonated beverage production system. A second valve 66 is provided in the carbonated beverage introduction pipe 65. By opening the second valve 66, the aseptic carbonated beverage (product fluid) from the carbonated beverage production system passes through the carbonated beverage introduction pipe 65 to be filled in the carbonated beverage filling tank 75. The carbonated beverage introduction pipe 65 is also connected to a below-described CIP circulation pipe 81. In the carbonated beverage introduction pipe 65, a cleaning fluid for the CIP processing and heating steam or hot water for the SIP processing also flow through a portion on the side of the carbonated beverage filling tank 75.

To the carbonated beverage filling tank 75, a carbon dioxide gas discharging pipe 86 is connected. The carbon dioxide gas discharging pipe 86 is connected to a below-described discharging tank 85. Further, a third valve 87 is provided in the carbon dioxide gas discharging pipe 86. If the third valve 87 is opened, the carbon dioxide gas inside the carbonated beverage filling tank 75 can be discharged toward the discharging tank 85. A pressure P2 inside the carbonate gas discharging pipe 86 is measured by a second pressure gauge 88 provided in the carbon dioxide gas discharging pipe 86. This pressure P2 is equal to the pressure inside the discharging tank 85.

In this case, the first valve 62 and the third valve 87 are controlled by a control part 60, so that the pressure inside the carbonated beverage filling tank 75 is controlled. Concretely, the relationship P1>P2 is established between the pressure P1 inside the carbonated beverage filling tank 75 measured by the first pressure gauge 64 and the pressure P2 inside the carbon dioxide discharging pipe 86 measured by the second pressure gauge 88. The pressure P1 inside the carbonated beverage filling tank 75 may be controlled to be, for example 0.01 MPa or more and 1.0 MPa or less. Further, the pressure P2 inside the carbon dioxide gas discharging pipe 86 may be controlled to be a pressure slightly exceeding 0 MPa, for example, 0.0001 MPa or more and 0.01 MPa or less. Due to this, it is possible to prevent gas in a non-aseptic state from entering the carbonated beverage filling tank 75 from the outside of the aseptic chamber 13. In this manner, as the discharging tank 85, a non-aseptic tank, which is not controlled in an aseptic state, can be used. In this case, the carbon dioxide gas discharging pipe 86 does not need to be connected to the aseptic tank in an aseptic state and therefore the above-described aseptic tank can be omitted from the carbonated beverage aseptic filling system 10. As a result, the manufacturing costs for the carbonated beverage aseptic filling system 10 can be reduced. The control part 60 comprises a control part for controlling the entire carbonated beverage aseptic filling system 10, while the control part is not limited to this case and may be configured to independently control the first valve 62 and the third valve 87. Further, the control can also be executed with the first pressure gauge 64 only without providing the second pressure gauge 88. Concretely, it is also possible that, based on an indicated value of the first pressure gauge 64, respective apertures of the first valve 62 and the third valve 87 are adjusted, and a value of the first pressure gauge 64 is controlled with both valves 62 and 87 so that the value is 0.01 MPa or more and 1.0 MPa or less during an apparatus sterilization (SIP) and until production termination.

To the carbonated beverage filling tank 75, a carbonated beverage supplying pipe 73 is connected. The carbonated beverage supplying pipe 73 is used for supplying the aseptic carbonated beverage filled in the carbonated beverage filling tank 75 to a below-described filling nozzle 72. The carbonated beverage filling tank 75 is connected to the filling nozzle 72 via the carbonated beverage supplying pipe 73.

Further, to the carbonated beverage filling tank 75, a counter pressure pipe 74 is connected. The counter pressure pipe 74 is used for supplying the aseptic carbon dioxide gas filled in the carbonated beverage filling tank 75 to the below-described filling nozzle 72. The carbonated beverage filling tank 75 is connected to the filling nozzle 72 via the counter pressure pipe 74.

In the carbonated beverage filling part 20, the aseptic carbonated beverage filled in the carbonated beverage filling tank 75 is filled into the empty bottle 30. The carbonated beverage filling part 20 has a conveying wheel 71 that rotates around an axis parallel to a vertical direction. A plurality of bottles 30 rotate (revolve) by the conveying wheel 71, while the bottles 30 are filled with an aseptic carbonated beverage. Further, the plurality of filling nozzles 72 are arranged along an outer circumference of the conveying wheel 71. One bottle 30 is fitted to each filling nozzle 72 and the aseptic carbonated beverage is injected into the bottles 30 from the filling nozzles 72. The configuration of the filling nozzle 72 will be described later.

The conveying wheel 71, the filling nozzle 72, at least part of the carbonated beverage supplying pipe 73, and at least part of the counter pressure pipe 74 are enclosed by a cover 76 constituting a portion of the aseptic chamber 13. To an upper part of the cover 76, a rotary joint 77 is attached. The carbonated beverage supplying pipe 73 and the counter pressure pipe 74 are attached to the cover 76 of the aseptic chamber 13 through the rotary joint 77. The rotary joint 77 seals, in an aseptic state, rotating bodies (the conveying wheel 71, the filling nozzle 72 as well as rotation pipes, etc. of the carbonated beverage supplying pipe 73 and the counter pressure pipe 74) and non-rotating bodies (the cover 76 as well as fixed pipes, etc. of the carbonated beverage supplying pipe 73 and the counter pressure pipe 74).

To the respective filling nozzles 72, the carbonated beverage supplying pipe 73 and the counter pressure pipe 74 are connected. The carbonated beverage supplying pipe 73 of these pipes has its one end connected to the carbonated beverage filling tank 75 filled with the aseptic carbonated beverage and communicates with the inside of the bottle 30 at the other end. Then, the aseptic carbonated beverages supplied from the carbonated beverage filling tank 75 passes through the carbonated beverage supplying pipe 73 and is injected into the bottle 30. As also described in JP 2008-105699 A, the counter pressure pipe 74 has its one end connected to the carbonated beverage filling tank 75 and communicates with the inside of the bottle 30 at the other end. A gas for a counter pressure composed of aseptic carbon dioxide gas, supplied from the carbonated beverage filling tank 75 passes through the counter pressure pipe 74 and is filled inside the bottle 30. A counter gas manifold part 53 is provided in the middle of the counter pressure pipe 74, and the counter pressure pipe 74 from the carbonated beverage filling tank 75 branches into a plurality of pipes at the counter gas manifold part 53 to extend to the respective filling nozzles 72.

Further, to the respective filling nozzles 72, a snift pipe 78 is connected. The snift pipe 78 has its one end connected to the counter pressure pipe 74 and extends outward from the aseptic chamber 13 at the other end. The gas inside the bottle 30 can be discharged via the snift pipe 78. A snift pipe manifold part 56 is provided in the middle of the snift pipe 78, and the carbon dioxide gas from the snift pipe 78 is integrated in the snift pipe manifold part 56 to be discharged into the aseptic chamber 13. A discharging valve 79 is provided in the snift pipe 78 inside the aseptic chamber 13. By this discharging valve 79, the carbon dioxide gas from the snift pipe 78 is discharged into the aseptic chamber 13. The snifting pipe manifold part 56 and the counter gas manifold part 53 are connected to each other by a first bypass pipe 54. In the first bypass pipe 54, a fourth valve 55 is provided and, generally, this fourth valve 55 is closed.

In this case, the snift pipe 78 has an inner snift pipe **78*a* and an outer snift pipe 78*b*. The inner snift pipe 78*a* has its one end connected to the filling nozzle 72 and is connected to the discharging valve 79 at the other end. The whole body of the inner snift pipe 78*a* is located inside the aseptic chamber 13, and the above-described snifting pipe manifold part 56 is located in the middle of the inner snift pipe 78*a*. The inner snift pipe 78*a* is also of a rotation type and rotates together with the filling nozzle 72**.

The outer snift pipe **78*b* has its one end connected to the discharging valve 79 and is opened at the other end outside the aseptic chamber 13. The outer snift pipe 78*b* has a portion thereof located inside the aseptic chamber 13 and has the remaining part located outside the aseptic chamber 13. The outer snift pipe 78***b* is of a non-rotation type and does not rotate together with the filling nozzle 72.

The above-described discharging valve 79 is located between the inner snift pipe 78*a* and the outer snift pipe 78*b*. The inner snift pipe 78*a* and the outer snift pipe 78*b* are detachable in the discharging valve 79. The discharging valve 79 can also be opened and closed and, in a normal state, it is opened. When the discharging valve 79 is in an opened state, the inner snift pipe 78*a* is physically separated from the outer snift pipe 78*b*, and the inner snift pipe 78*a* communicates with the inside of the aseptic chamber 13 in the discharging valve 79. When the discharging valve 79 is closed, the inner snift pipe 78*a* is connected to the outer snift pipe 78*b*, and the inner snift pipe 78*a* communicates with the outer snift pipe 78*b*. At this time, the inner snift pipe 78*a* does not communicate with the inside of the aseptic chamber 13. Conventionally, as described in e.g. JP 2005-14918 A, the snift pipe is opened to the atmosphere via a rotary joint and a snifting pipe.

The outer snift pipe 78*b* is also stretchable in a bellows 78*c*. When the discharging valve 79 is opened, the bellows 78*c* of the outer snift pipe 78*b* contracts, and the outer snift pipe 78*b* is separated from the inner snift pipe 78*a*. At this time, the inner snift pipe 78*a* can rotate, while it communicates with the interior of the aseptic chamber 13 in the discharging valve 79. Meanwhile, when the exhaust valve 79 is closed, the rotation of the inner snift pipe 78*a* is stopped, and the inner snift pipe 78*a* and the outer snift pipe 78*b* are positioned in a rotation direction. In this state, the bellows 78*c* of the outer snift pipe 78*b* is stretched, and the outer snift pipe 78*b* is connected to the inner snift pipe 78*a* in the exhaust valve 79. At this time, the inner snift pipe 78*a* is integrated with the outer snift pipe 78*b* to communicate with the outer snift pipe 78*b*.

As described above, the carbon dioxide gas from the snift pipe 78 is discharged into the aseptic chamber 13 by using the discharging valve 79, so that the carbon dioxide gas inside the bottle 30 can be discharged into the aseptic chamber 13, which is an aseptic space, without being contaminated by bacteria. Further, it is not necessary to provide a rotary joint for connecting the rotating snift pipe 78 to the outside of the aseptic chamber 13. Generally, the above-described rotary joint has a complicated mechanism and is expensive. For this reason, the mechanism of the carbonated beverage aseptic filling system 10 can be simplified by omitting the rotary joint for the snift pipe 78 and thereby, the manufacturing costs can be reduced.

By the way, as for the flow path in the carbonated beverage aseptic filling system 10 through which the beverage (raw liquid, sterilized beverage, or aseptic carbonated beverage) passes, the CIP (cleaning in place) is performed and the SIP (sterilizing in place) is further preferably performed periodically or when changing the type of beverage. The CIP processing is performed on the flow path from a conduit interior of the path for supplying the raw liquid to the filling nozzle 72 of the carbonated beverage filling part 20 by, for example, letting a cleaning fluid obtained by adding an alkaline agent such as caustic soda to water flow therethrough, and then letting a cleaning fluid obtained by adding an acid agent to water flow therethrough. In this manner, residues, etc. of the previous beverage adhering to the interior of the flow path, through which the beverage passes, are removed. The SIP processing is also a processing for sterilizing in advance the interior of the flow path, through which the beverage passes, before the filling work of the beverage is started and is performed for example, by letting heated steam or hot water flow through the interior of the flow path cleaned in accordance with the above CIP. In this manner, the interior of the flow path, through which the beverage passes, is sterilized and put in an aseptic state.

In order to perform the above-described CIP processing, a CIP cup 82 is provided in the vicinity of the filling nozzle 72 to receive the cleaning fluid from the filling nozzle 72. To the CIP cup 82, a CIP pipe 83 is connected. The CIP pipe 83 has its one end connected to the CIP cup 82 and has the other end connected to the discharging tank 85 disposed outside the aseptic chamber 13. The cleaning fluid from the filling nozzle 72 can be discharged to the discharging tank 85 through the CIP pipe 83. A CIP pipe manifold part 59 is provided in the middle of the CIP pipe 83, and the cleaning fluid from the CIP pipe 83 is collectively recovered in the CIP pipe manifold part 59 to be discharged to the discharging tank 85. The CIP pipe manifold part 59 and the snifting pipe manifold part 56 are connected through a second bypass pipe 57. The second bypass pipe 57 is provided with a fifth valve 58. Generally, the fifth valve 58 is closed.

In this case, the CIP pipe 83 has an inner CIP pipe 83*a* and an outer CIP pipe 83*b*. The inner CIP pipe 83*a* has its one end connected to the CIP cup 82 and is connected to a connection valve 84 at the other end. The whole body of the inner CIP pipe 83*a* is located inside the aseptic chamber 13, and the above-described CIP pipe manifold part 59 is located in the middle of the inner CIP pipe 83*a*. The inner CIP pipe 83*a* is also of a rotation type and rotates together with the filling nozzle 72.

The outer CIP pipe 83*b* has its one end connected to the connection valve 84 and is connected to the discharging tank 85 at the other end. The outer CIP pipe 83*b* has its part located inside the aseptic chamber 13 and has the remaining part located outside the aseptic chamber 13. The outer CIP pipe 83*b* is of a non-rotation type and does not rotate together with the filling nozzle 72.

The connection valve 84 is located between the inner CIP pipe 83*a* and the outer CIP pipe 83*b*. The inner CIP pipe 83*a* and the outer CIP pipe 83*b* are detachable in the connection valve 84. The connection valve 84 can be opened and closed and, in a normal state, it is opened. When the connection valve 84 is in an opened state, the inner CIP pipe 83*a* is physically separated from the outer CIP pipe 83*b*, and the inner CIP pipe 83*a* communicates with the inside of the aseptic chamber 13 in the connection valve 84. When the connection valve 84 is closed, the inner CIP pipe 83*a* is connected to the outer CIP pipe 83*b*, and the inner CIP pipe 83*a* communicates with the discharging tank 85 via the outer CIP pipe 83*b*. The configuration of the connection valve 84 may be approximately identical to the configuration of the above-described discharging valve 79. It is also possible to open the fifth valve 58, thereby discharging the gas inside the bottle 30 conveyed from the snift pipe 78, from the connection valve 84 into the aseptic chamber 13.

The outer CIP pipe 83*b* is freely stretchable in a bellows 83*c*. When the connection valve 84 is opened, the bellows 83*c* of the outer CIP pipe 83*b* contracts, and the outer CIP pipe 83*b* is separated from the inner CIP pipe 83*a* in the connection valve 84. At this time, the inner CIP pipe 83*a* can rotate, while it communicates with the interior of the aseptic chamber 13. Meanwhile, when the connection valve 84 is closed, the inner CIP pipe 83*a* and the outer CIP pipe 83*b* are positioned in the rotation direction. In this state, the bellows 83*c* of the outer CIP pipe 83*b* is stretched, and the outer CIP pipe 83*b* is connected to the inner CIP pipe 83*a* in the connection valve 84. Then, the inner CIP pipe 83*a* is integrated with the outer CIP pipe 83*b* and communicates with the outer CIP pipe 83*b*.

Above the discharging tank 85, an exhaust pipe 89 is provided to discharge the gas inside the discharging tank 85. To the exhaust pipe 89, a non-illustrated scrubber for processing the gas is connected. Further, the above-described CIP circulation pipe 81 is connected below the discharging tank 85. The CIP circulation pipe 81 is a pipe for sending the cleaning fluid stored in the discharging tank 85 toward the side of the carbonated beverage filling tank 75, so that the cleaning fluid is circulated. The CIP circulation pipe 81 connects the discharging tank 85 to the middle part of the carbonated beverage introduction pipe 65. In the CIP circulation pipe 81, a cleaning fluid supplying part 94, a pump 91, a sixth valve 92, a heater 93 and a seventh valve 95 are provided in this order from the side of the discharging tank 85. Further, a fluid drainage pipe 96 is connected between the pump 91 and the sixth valve 92, and an eighth valve 97 is provided in the fluid drainage pipe 96. The fluid drainage pipe 96 may be provided between the heater 93 and the seventh valve 95, and other drainage may be appropriately added at any location where residual water in each pipe can be quickly drained.

In the cover 76 of the aseptic chamber 13, an aseptic air supplying device 70 is provided to blow a large amount of aseptic air into the aseptic chamber 13. The aseptic air supplying device 70 introduces the aseptic air into the aseptic chamber 13, so that the interior of the aseptic chamber 13 is maintained at a positive pressure to prevent outside air from entering the aseptic chamber 13. The aseptic air supplying device 70 blows a large amount of aseptic air into the aseptic chamber 13 and therefore, as described above, even if the carbon dioxide gas is discharged from the discharging valve 79 into the aseptic chamber 13, the concentration of the carbon dioxide gas inside the aseptic chamber 13 is not likely to rise excessively. The supply amount of aseptic air for fulfilling the above object is from 5 $m^3$/min to 100 $m^3$/min, preferably from 10 $m^3$/min to 50 $m^3$/min.

Filling Nozzle

Next, by referring to FIG. 3, the configuration of the filling nozzle 72 of the above-described carbonated beverage filling part 20 will be explained.

As shown in FIG. 3, the filling nozzle 72 has a body part 72*a*. To the body part 72*a*, the carbonated beverage supplying pipe 73 and the counter pressure pipe 74 are respectively connected. The carbonated beverage supplying pipe 73 has its upper end connected to the carbonated beverage filling tank 75 and communicates with the interior of the bottle 30 at the lower end. The aseptic carbonated beverage supplied from the carbonated beverage filling tank 75 passes through the carbonated beverage supplying pipe 73 to be injected into the bottle 30.

As described in JP 2008-105699 A, the counter pressure pipe 74 has its upper end connected to the carbonated beverage filling tank 75 and communicates with the interior of the bottle 30 at the lower end. The gas for counter pressuring such as the carbon dioxide gas supplied from the carbonated beverage filling tank 75 passes through the counter pressure pipe 74 to be filled inside the bottle 30. The snift pipe 78 is connected to the middle of the counter pressure pipe 74, so that the carbon dioxide gas, etc. inside the bottle 30 can be discharged through the snift pipe 78.

The carbonated beverage supplying pipe 73 and the counter pressure pipe 74 pass through the rotary joint 77 provided in the cover 76. Meanwhile, the snift pipe 78 discharges the carbon dioxide gas from the snift pipe 78 into the aseptic chamber 13 without the rotary joint intervening as described above.

Aseptic Carbonated Beverage Filling Method

Next, an aseptic carbonated beverage filling method using the above-described carbonated beverage aseptic filling system 10 (FIG. 1) will be explained. The filling method under normal conditions, namely, the aseptic carbonated beverage filling method for filling the aseptic carbonated beverage into the bottle 30 to produce the product bottle 35 will be explained below.

First, a plurality of empty bottles 30 are successively supplied from the bottle supplying part 21 from the outside of the carbonated beverage aseptic filling system 10. The bottle 30 is conveyed by the conveying wheel 12 from the bottle supplying part 21 to the bottle sterilizing part 11 (container supplying process).

Next, in the bottle sterilizing part 11, a sterilizing process is performed on the bottle 30 by using a hydrogen peroxide aqueous solution as a sterilizing agent (sterilizing process). At this time, the hydrogen peroxide aqueous solution is a gas or mist obtained by gasifying once and then condensing the hydrogen peroxide aqueous solution with a concentration of at least 1 wt %, preferably 35 wt %, and this gas or mist is supplied to the bottle 30.

Subsequently, the bottle 30 is conveyed by the conveying wheel 12 to the air rinsing part 14. In the air rinsing part 14, the aseptic heated air or normal temperature air is supplied to the bottle 30, thereby activating hydrogen peroxide and simultaneously removing foreign materials and hydrogen peroxide, etc. from the bottle 30. Next, the bottle 30 is conveyed by the conveying wheel 12 to the aseptic water rinsing part 15. In this aseptic water rinsing part 15, cleaning is performed by means of aseptic water at 15° C. or higher and 85° C. or lower (rinsing process). Concretely, aseptic water at 15° C. or higher and 85° C. or lower is supplied into the bottle 30 at a flow rate of 5 L/min or more and 15 L/min or less. At this time, the bottle 30 is preferably inverted and aseptic water is supplied into the bottle 30 from the downward-facing opening, so that the aseptic water flows outward from the opening of bottle 30. By the aseptic water, hydrogen peroxide adhering to the bottle 30 is washed down and the foreign materials are removed. The process of supplying the aseptic water into the bottle 30 is not necessarily provided.

Next, the bottle 30 is conveyed by the conveying wheel 12 to the carbonated beverage filling part 20. In this carbonated beverage filling part 20, the bottle 30 rotates (revolves), while the bottle 30 is filled with an aseptic carbonated beverage through its opening (filling process). In the carbonated beverage filling part 20, the sterilized bottle 30 is filled with the aseptic carbonated beverage conveyed from the carbonated beverage filling tank 75 at a filling temperature of 1° C. or higher and 40° C. or lower, preferably 5° C. or higher and 10° C. or lower.

During this period, as shown in FIG. 3, in the carbonated beverage filling part 20, the filling nozzle 72 closely contacts with the opening of the bottle 30, so that the counter pressure pipe 74 and the bottle 30 communicate with each other. At this time, the snift pipe 78 is closed. Next, the aseptic carbon dioxide gas for counter pressuring is supplied from the carbonated beverage filling tank 75 into the bottle 30 through the counter pressure pipe 74. In this manner, an internal pressure of the bottle 30 is made higher than atmospheric pressure, and the internal pressure of the bottle 30 becomes identical to the internal pressure of the carbonated beverage filling tank 75.

Next, the aseptic carbonated beverage is filled into the bottle 30 from the carbonated beverage supplying pipe 73. In this case, the aseptic carbonated beverage passes through the carbonated beverage supplying pipe 73 from the carbonated beverage filling tank 75 to be injected into the bottle 30.

Subsequently, the supplying of the aseptic carbonated beverage from the carbonated beverage supplying pipe 73 is stopped. Next, the carbonated beverage supplying pipe 73 and the counter pressure pipe 74 are closed and, at the same time, the snift pipe 78 is opened, so that the gas inside the bottle 30 is discharged from the snift pipe 78. Due to this, the internal pressure of the bottle 30 becomes equivalent to the atmospheric pressure, and the filling of the bottle 30 with the aseptic carbonated beverage is completed. Then, the gas from the bottle 30 passes through the snift pipe 78 and thereafter it is discharged into the aseptic chamber 13 from the discharging valve 79.

Referring again to FIG. 1, the bottle 30 filled with the aseptic carbonated beverage in the carbonated beverage filling part 20 is conveyed by the conveying wheel 12 to the cap fitting part 16.

Meanwhile, the cap 33 is sterilized in advance by the cap sterilizing part 25 (cap sterilizing process). In the cap fitting part 16, the cap 33 sterilized in the cap sterilizing part 25 is fitted to the opening of the bottle 30 having been conveyed from the carbonated beverage filling part 20. In this manner, the product bottle 35 with the bottle 30 and the cap 33 can be obtained (cap fitting process).

Thereafter, the product bottle 35 is conveyed from the cap fitting part 16 to the product bottle carry-out part 22 and conveyed to the outside of the carbonated beverage aseptic filling system 10.

The respective processes from the above sterilizing process to the cap fitting process are carried out in an aseptic atmosphere enclosed by the aseptic chamber 13, namely, under an aseptic environment. The aseptic air at a positive pressure is supplied from the aseptic air supplying device 70 into the aseptic chamber 13, so that the aseptic air always blows outward from the aseptic chamber 13.

The speed of the production (conveyance) of the bottle 30 in the carbonated beverage aseptic filling system 10 is preferably set from 100 bpm to 1500 bpm. Bpm (bottles per minute) indicates a conveyance speed per minute for the bottle 30.

As described above, according to the present embodiment, the discharging valve 79 is provided in the snift pipe 78 inside the aseptic chamber 13, and the gas from the snift pipe 78 is discharged from the discharging valve 79 into the aseptic chamber 13. Due to this, it is not necessary to provide the rotary joint for connecting the snift pipe 78 between the rotating body (such as the filling nozzle 72) and the non-rotating body (such as the external part of the aseptic chamber 13). As a result, the rotary joint for the snift pipe 78 can be omitted and therefore the number of rotary joints in the entire system can be reduced, so that the entire configuration of the carbonated beverage aseptic filling system 10 can be simplified. The manufacturing costs of the carbonated beverage aseptic filling system 10 can also be reduced.

Further, according to the present embodiment, the discharging valve 79 is located between the rotating inner snift pipe 78*a* and the non-rotating outer snift pipe 78*b*. Due to this, the inner snift pipe 78*a* is normally separated from the outer snift pipe 78*b*, and the gas from the snift pipe 78 can be discharged from the discharging valve 79 into the aseptic chamber 13. Meanwhile, it is also possible that, by stopping the rotation of the inner snift pipe 78*a*, the inner snift pipe 78*a* and the outer snift pipe 78*b* are connected to close the discharging valve 79, thereby making the snift pipe 78 communicate with the outside of the aseptic chamber 13.

Further, according to the present embodiment, the outer snift pipe 78*b* is stretchable. Due to this, the inner snift pipe 78*a* is normally separated from the outer snift pipe 78*b*, and it is possible to prevent the outer snift pipe 78*b* from interfering with the rotating inner snift pipe 78*a*. Further, at the time of closing the discharging valve 79, the bellows 78*c* of the outer snift pipe 78*b* is stretched, so that the outer snift pipe 78*b* can be connected to the inner snift pipe 78*a* in the discharging valve 79.

Further, according to the present embodiment, the carbon dioxide gas supplying pipe 61 and the carbon dioxide gas discharging pipe 86 are connected to the carbonated beverage filling tank 75. Further, the first valve 62 and the third valve 87 are provided in the carbon dioxide gas supplying pipe 61 and the carbon dioxide gas discharging pipe 86, respectively, and the control part 60 controls each of the first valve 62 and the third valve 87 to control the pressure inside the carbonated beverage filling tank 75. Particularly, the control is executed in such a manner that the relation P1>P2 is established between the pressure P1 inside the carbonated beverage filling tank 75 and the pressure P2 inside the carbon dioxide gas discharging pipe 86. Due to this, it is possible to prevent a gas in a non-aseptic state from entering the carbonated beverage filling tank 75 from the outside of the aseptic chamber 13. For this reason, as the discharging tank 85, a non-aseptic tank that is not controlled in an aseptic state can be used. In this case, the carbon dioxide gas discharging pipe 86 does not need to be connected to the aseptic tank in the aseptic state and therefore this aseptic tank does not need to be provided in the carbonated beverage aseptic filling system 10, so that the manufacturing costs for the carbonated beverage aseptic filling system 10 can be reduced.

Further, it is also possible to execute the control by means of the first pressure gauge 64 only, without providing the second pressure gauge 88. Concretely, the respective apertures of the first valve 62 and the third valve 87 are adjusted based on the indicated value of the first pressure gauge 64, and the control is executed only with both valves 62 and 87, so that the value of the first pressure gauge 64 is from 0.01 MPa to 1.0 MPa during the apparatus sterilization (SIP) and until the production is finished. Due to this, it is possible to prevent the gas in the non-aseptic state from entering the carbonated beverage filling tank 75 from the outside of the aseptic chamber 13, so that the same effect as described above can be obtained.

In the above description, the sterilization for the containers such as the bottle 30, the preform, and the cap 33 has been explained by referring to the example where the sterilizing agent composed of hydrogen peroxide is used. The sterilization is not limited to this case and may be performed by using a sterilizing agent such as peracetic acid or an electron beam.

Second Embodiment

Next, a second embodiment will be explained by referring to FIGS. 4 to 10. FIGS. 4 to 10 show the second embodiment. The parts in FIGS. 4 to 10 that correspond to those in the first embodiment will be given the same numerals and their detailed explanation will be omitted. The second embodiment will be explained below by mainly referring to differences from the first embodiment.

Beverage Aseptic Filling System

First, the entire beverage aseptic filling system according to the present embodiment will be explained by referring to FIG. 4.

Figure 4:
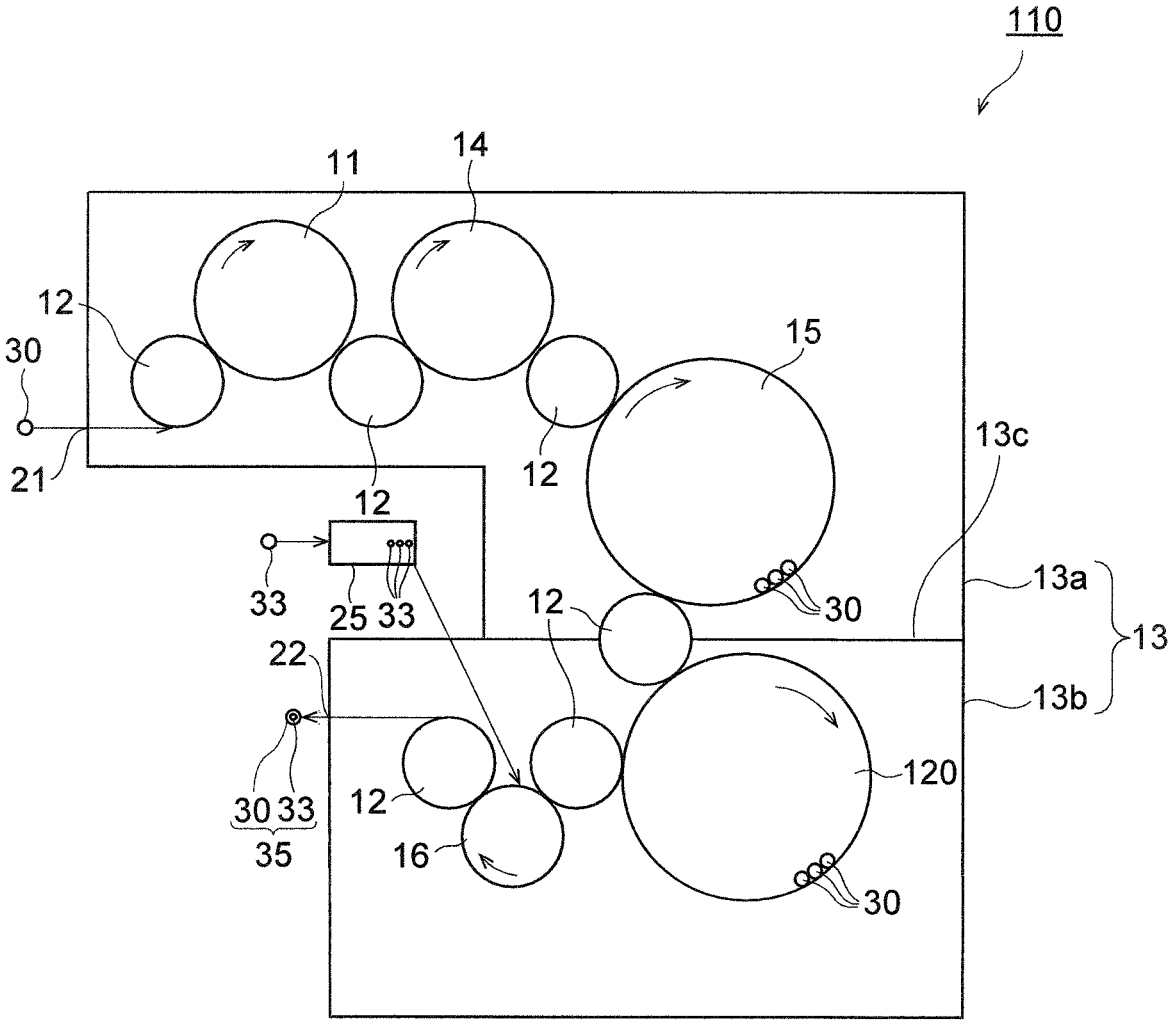
FIG. 4 is a schematic planar view showing a beverage aseptic filling system according to a second embodiment.

A beverage aseptic filling system 110 shown in FIG. 4 is a system for serving both carbonated beverages and non-carbonated beverages, namely, an aseptic filling system capable of alternatively filling, into the bottle (container) 30, both a beverage composed of a carbonated beverage and a beverage composed of a non-carbonated beverage. In the present embodiment, an example of using a plastic bottle as the container will be explained, while paper containers, glass bottles and cans, etc. may be used as the container.

As shown in FIG. 4, the beverage aseptic filling system 110 comprises a bottle supplying part 21, a bottle sterilizing part 11, an air rinsing part 14, an aseptic water rinsing part 15, a beverage filling part (filler) 120, a cap fitting part (capper, seaming and capping machine) 16, and a product bottle carry-out part 22.

The beverage filling part 120 fills an aseptic carbonated beverage or an aseptic non-carbonated beverage sterilized beforehand, or a non-sterilized carbonated beverage not requiring sterilization (hereinafter merely referred to as "beverage") into the bottles 30 through the openings of the bottles 30.

If the beverage to be filled into the bottles 30 is a carbonated beverage (aseptic carbonated beverage or non-sterilized carbonated beverage), the carbonated beverage is filled into the bottles 30 at the filling temperature of 1° C. or higher and 40° C. or lower, preferably 5° C. or higher and 10° C. or lower.

If the beverage to be filled into the bottles 30 is an aseptic non-carbonated beverage, the beverage is filled into the bottles 30 at the filling temperature of 1° C. or higher and 40° C. or lower, preferably 10° C. or higher and 30° C. or lower. The aseptic non-carbonated beverage filled by the beverage filling part 120 includes, for example, a non-carbonated beverage containing components originated from animals or plants such as fruit juice and milk components.

Moreover, the configurations of the bottle supplying part 21, the bottle sterilizing part 11, the air rinsing part 14, the aseptic water rinsing part 15, the cap fitting part 16, and the product bottle carry-out part 22 are approximately identical to those in the first embodiment.

Next, by referring to FIG. 5, the beverage filling part 120 of the beverage aseptic filling system 110 and its peripheral configuration will be explained.

Figure 5:
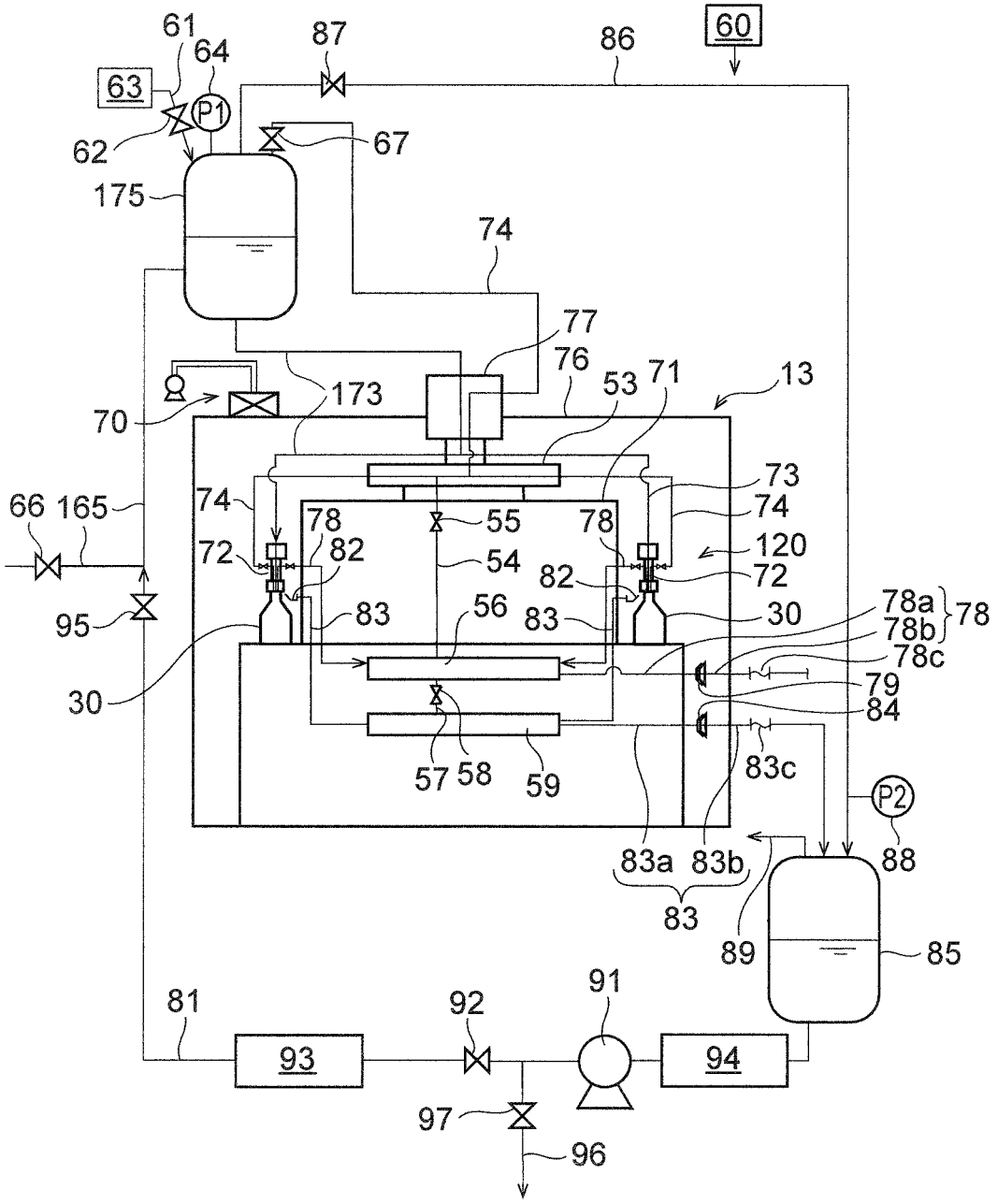
FIG. 5 is a schematic view showing a beverage filling part and a flow of fluid in its periphery of a beverage aseptic filling system according to a second embodiment.

As shown in FIG. 5, a beverage filling tank (filling head tank or buffer tank) 175 is disposed above the beverage filling part 120. The beverage filling tank 175 is filled with a beverage (carbonated or non-carbonated beverage). The beverage filling tank 175 is connected to the aseptic carbon dioxide supplying part 63 via the carbon dioxide gas supplying pipe 61. In the present embodiment, the carbon dioxide gas supplying pipe 61, the first valve 62, and the aseptic carbon dioxide supplying part 63 are used when the beverage to be filled is a carbonated beverage.

To the beverage filling tank 175, a beverage introduction pipe 165 is connected. The beverage introduction pipe 165 is connected to a non-illustrated beverage production system. To the beverage filling tank 175, a carbon dioxide gas discharging pipe 86 is connected. The carbon dioxide gas discharging pipe 86 is used when the beverage to be filled is a carbonated beverage and is connected to the discharging tank 85. It is also possible not to provide the discharging tank 85 but to provide the carbon dioxide gas discharging pipe 86 with a (non-illustrated) disinfection filter sterilized by steam prior to manufacturing, thereby discharging the carbon dioxide gas from the carbon dioxide gas discharging pipe 86. Additionally, the configuration of the beverage filling tank 175 is approximately identical to the configuration of the above-described carbonated beverage filling tank 75.

To the beverage filling tank 175, a beverage supplying pipe 173 is connected. The beverage supplying pipe 173 is a pipe for supplying the beverage filled in the beverage filling tank 175 to the filling nozzle 72 described later. The beverage filling tank 175 is connected to the filling nozzle 72 via the beverage supplying pipe 173.

To the beverage filling tank 175, the counter pressure pipe 74 is further connected. The counter pressure pipe 74 is a pipe for supplying, to the filling nozzle 72 described later, the aseptic carbon dioxide gas used when the beverage to be filled is a carbonated beverage, filled in the beverage filling tank 175. The beverage filling tank 175 is connected to the filling nozzle 72 via the counter pressure pipe 74.

On the counter pressure pipe 74, a counter gas valve 67 is provided at a connection part between the beverage filling tank 175 and the counter pressure pipe 74. The counter gas valve 67 is directly connected to the beverage filling tank 175. The counter gas valve 67 is opened when the beverage to be filled is a carbonated beverage and closed when the beverage to be filled is a non-carbonated beverage. The counter gas valve 67 is also opened when the beverage to be filled into the bottle 30 immediately before performing the CIP processing is a carbonated beverage, and closed when the beverage to be filled into the bottle 30 immediately before performing the CIP processing is a non-carbonated beverage.

In the beverage filling part 120, the beverage filled in the beverage filling tank 175 is filled into the empty bottle 30. The beverage filling part 120 comprises the conveying wheel 71 that rotates around an axis parallel to a vertical direction. By the conveying wheel 71, a plurality of bottles 30 rotate (revolve), while the bottles 30 are filled with the beverage. Further, a plurality of filling nozzles 72 are arranged along the outer circumference of the conveying wheel 71. One bottle 30 is fitted to each filling nozzle 72 and the beverage is injected into the bottle 30 from the filling nozzle 72. The configuration of the filling nozzle 72 is described later.

To each filling nozzle 72, the snift pipe 78 is further connected. The snift pipe 78 is used when the beverage to be filled is a carbonated beverage. The snift pipe 78 has its one end connected to the counter pressure pipe 74 and extends at the other end outward from the aseptic chamber 13.

The control part 60 controls the beverage aseptic filling system 110 and performs the CIP processing and the SIP processing on the flow path, through which the beverage and the carbon dioxide gas pass. As described above, the beverage aseptic filling system 110 is a system for serving both carbonated beverages and non-carbonated beverages, namely, a filling system capable of alternatively filling, into the bottle 30, both a beverage composed of a carbonated beverage and a beverage composed of a non-carbonated beverage.

In the present embodiment, when performing the CIP processing, the control part 60 executes the control in different manners, depending on whether the beverage filled into the bottle 30 immediately before the CIP processing is a carbonated beverage or non-carbonated beverage.

Concretely, if the beverage filled into the bottle 30 immediately before the CIP processing is a carbonated beverage, the control part 60 performs the CIP processing on all the flow paths used for filling the carbonated beverage, through which the carbonated beverage and the carbon dioxide gas pass. The flow paths as described above include the carbonated beverage exclusive flow path used only for filling carbonated beverages, and the carbonated/non-carbonated beverage flow path used for filling both carbonated beverages and non-carbonated beverages.

Meanwhile, if the beverage filled into the bottle 30 immediately before the CIP processing is a non-carbonated beverage, the control part 60 performs the CIP cleaning on only the flow path used for filling the non-carbonated beverage, through which the non-carbonated beverage passes. The flow path as described above includes the carbonated/non-carbonated beverage flow path serving to fill both carbonated beverages and non-carbonated beverages. In this case, the CIP cleaning is not performed on the carbonated beverage exclusive flow path.

In the example shown in FIG. 5, the carbonated/non-carbonated beverage flow path includes the beverage introduction pipe 165, the second valve 66, the beverage filling tank 175, the beverage supplying pipe 173, the rotary joint 77, the beverage supplying pipe 173, the filling nozzle 72, the CIP cup 82, the CIP pipe 83, the connection valve 84, the CIP pipe manifold part 59, the discharging tank 85, the cleaning fluid supplying part 94, the pump 91, the eighth valve 97, the fluid drainage pipe 96, the sixth valve 92, the heater 93, the CIP circulation pipe 81, and the seventh valve 95, etc. Though not illustrated, any flow paths for the fluids (such as beverages and gases) used for filling both a carbonated beverage and a non-carbonated beverage, those requiring the CIP cleaning, are included in the carbonated/non-carbonated beverage flow path.

Further, in the example shown in FIG. 5, the carbonated beverage exclusive flow path includes the counter gas valve 67, the counter pressure pipe 74, the counter gas manifold part 53, the snift pipe 78, the fourth valve 55, the first bypass pipe 54, the snifting pipe manifold part 56, the fifth valve 58, the discharging valve 79, the carbon dioxide gas discharging pipe 86, and the third valve 87, etc. Though not illustrated, any flow paths for the fluids (such as beverages and gases) used only for filling a carbonated beverage, those requiring the CIP cleaning, are included in the carbonated beverage exclusive flow path.

Moreover, the beverage filling part 120 of the beverage aseptic filling system 110 and its peripheral configuration are approximately identical to those in the above-described first embodiment.

Filling Nozzle

Next, by referring to FIG. 6, the configuration of the filling nozzle 72 of the above-described beverage filling part 120 will be explained.

Figure 6:
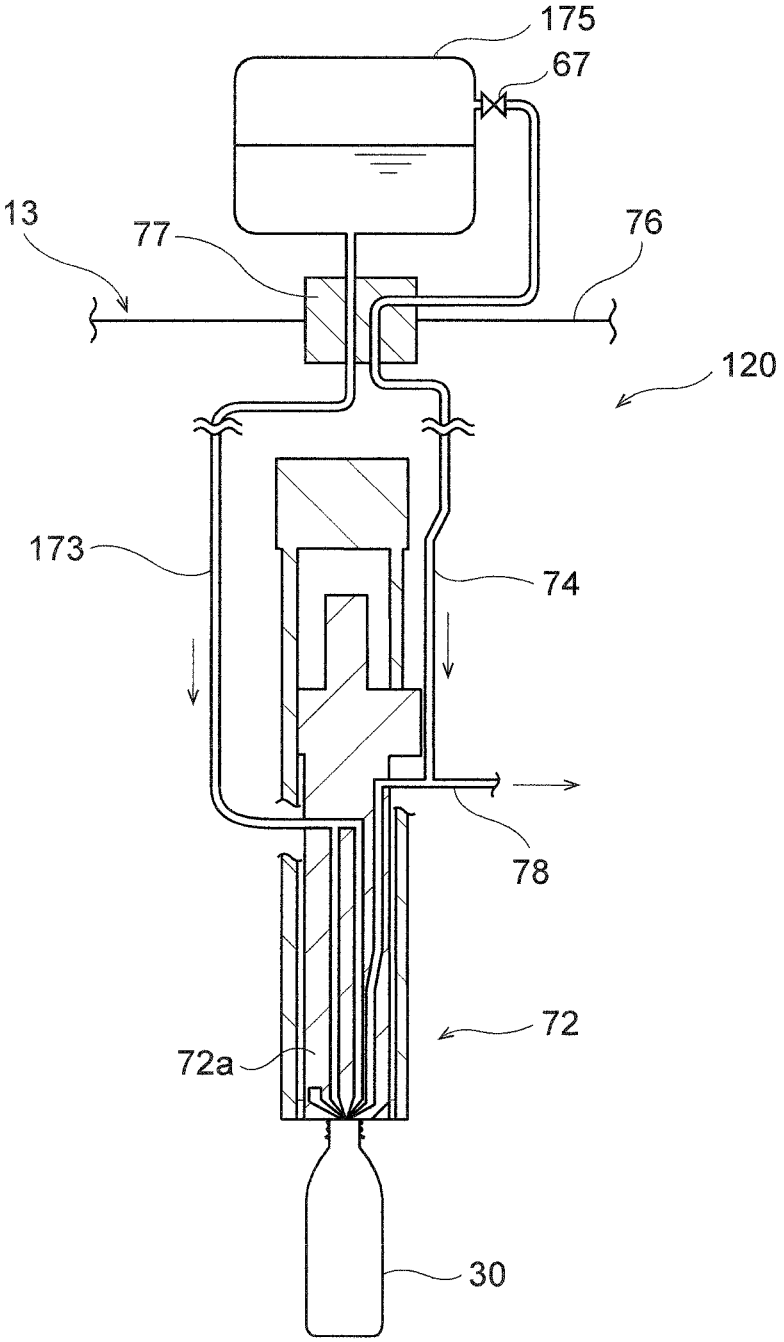
FIG. 6 is a schematic sectional view showing a filling nozzle of a beverage filling part of a beverage aseptic filling system according to a second embodiment.

As shown in FIG. 6, the filling nozzle 72 has the body part 72*a*. To the body part 72*a*, a beverage supplying pipe 173 and the counter pressure pipe 74 are respectively connected. The beverage supplying pipe 173 has its upper end connected to the beverage filling tank 175 and communicates with the interior of the bottle 30 at the lower end. The beverage supplied from the beverage filling tank 175 passes through the beverage supplying pipe 173 to be injected into the bottle 30.

The counter pressure pipe 74 is used when the beverage to be filled is a carbonated beverage. The counter pressure pipe 74 has its upper end connected to the beverage filling tank 175 and communicates with the interior of the bottle 30 at the lower end. The gas for counter pressuring such as the carbon dioxide gas supplied from the beverage filling tank 175 passes through the counter pressure pipe 74 to be filled into the bottle 30. The snift pipe 78 is connected to the middle of the counter pressure pipe 74, so that the carbon dioxide gas, etc. inside the bottle 30 can be discharged through the snift pipe 78.

The beverage supplying pipe 173 and the counter pressure pipe 74 pass through the rotary joint 77 provided in the cover 76. Meanwhile, the snift pipe 78 discharges the carbon dioxide gas from the snift pipe 78 into the aseptic chamber 13 without the rotary joint intervening as described above.

Aseptic Carbonated Beverage Filling Method

The aseptic carbonated beverage filling method using the beverage aseptic filling system 110 (FIG. 4) under normal conditions can be implemented in a manner approximately identical to the case of the first embodiment.

Aseptic Non-Carbonated Beverage Filling Method

Next, an aseptic non-carbonated beverage filling method using the beverage aseptic filling system 110 (FIG. 4) will be explained. The method for filling the aseptic non-carbonated beverage under normal conditions, namely, the aseptic non-carbonated beverage filling method for filling the aseptic non-carbonated beverage into the bottle 30 to produce the product bottle 35 will be explained below.

First, as in case of the aseptic carbonated beverage filling method in the first embodiment, the bottle 30 is conveyed to the beverage supplying part 120 sequentially via the bottle supplying part 21 (container supplying process), the bottle sterilizing part 11 (sterilizing process), and the air rinsing part 14 and the aseptic water rinsing part 15 (rinsing process). In this beverage filling part 120, the bottle 30 is filled with an aseptic non-carbonated beverage (filling process).

During this period, as shown in FIG. 6, in the beverage filling part 120, when the filling nozzle 72 is in a state of not closely contacting with the opening of the bottle 30, the aseptic non-carbonated beverages is filled into the bottle 30 from the beverage supplying pipe 173. The aseptic non-carbonated beverage passes through the beverage supplying pipe 173 from the beverage filling tank 175 to be injected into the bottle 30. After this, the supply of the aseptic non-carbonated beverages from the beverage supplying pipe 173 is stopped. At this time, the counter pressure pipe 74 and the snift pipe 78 are closed by the counter gas valve 67 and a non-illustrated valve, respectively.

The bottle 30 having the aseptic non-carbonated beverage filled thereinto in the beverage filling part 120 is conveyed to the cap fitting part 16, where the cap 33 is fitted to the opening of the bottle 30. In this manner, the product bottle 35 with the bottle 30 and the cap 33 can be obtained (cap fitting process).

Thereafter, the product bottle 35 is conveyed from the cap fitting part 16 to the product bottle carry-out part 22 and conveyed to the outside of the beverage aseptic filling system 110.

CIP Processing Method

Next, in the beverage aseptic filling system 110, the work when performing the CIP (cleaning in place) processing, for example periodic work or when switching the type of beverage, will be explained.

First, the CIP processing is performed on the inside of the beverage supplying pipe of the beverage aseptic filling system 110. In this case, it is initially determined whether the beverage filled into the bottle 30 immediately before the CIP processing is a carbonated beverage or non-carbonated beverage. The control part 60 selects a flow path to be CIP-cleaned, depending on the beverage filled into the bottle 30 immediately before the CIP processing, and the selected flow path is subjected to the CIP-cleaning.

CIP Processing Method After Filling Carbonated Beverage

Concretely, if the beverage filled into the bottle 30 immediately before the CIP processing is a carbonated beverage, the control part 60 performs the CIP cleaning on all the flow paths used for filling the carbonated beverage, through which the beverage and the carbon dioxide gas pass. In this case, for example, a cleaning fluid obtained by adding an alkaline agent such as caustic soda to water is allowed to flow through all of the carbonated beverage exclusive path and the carbonated/non-carbonated beverage flow path. After this, a cleaning fluid obtained by adding an acid agent to water is allowed to flow through the flow paths.

Figure 7:
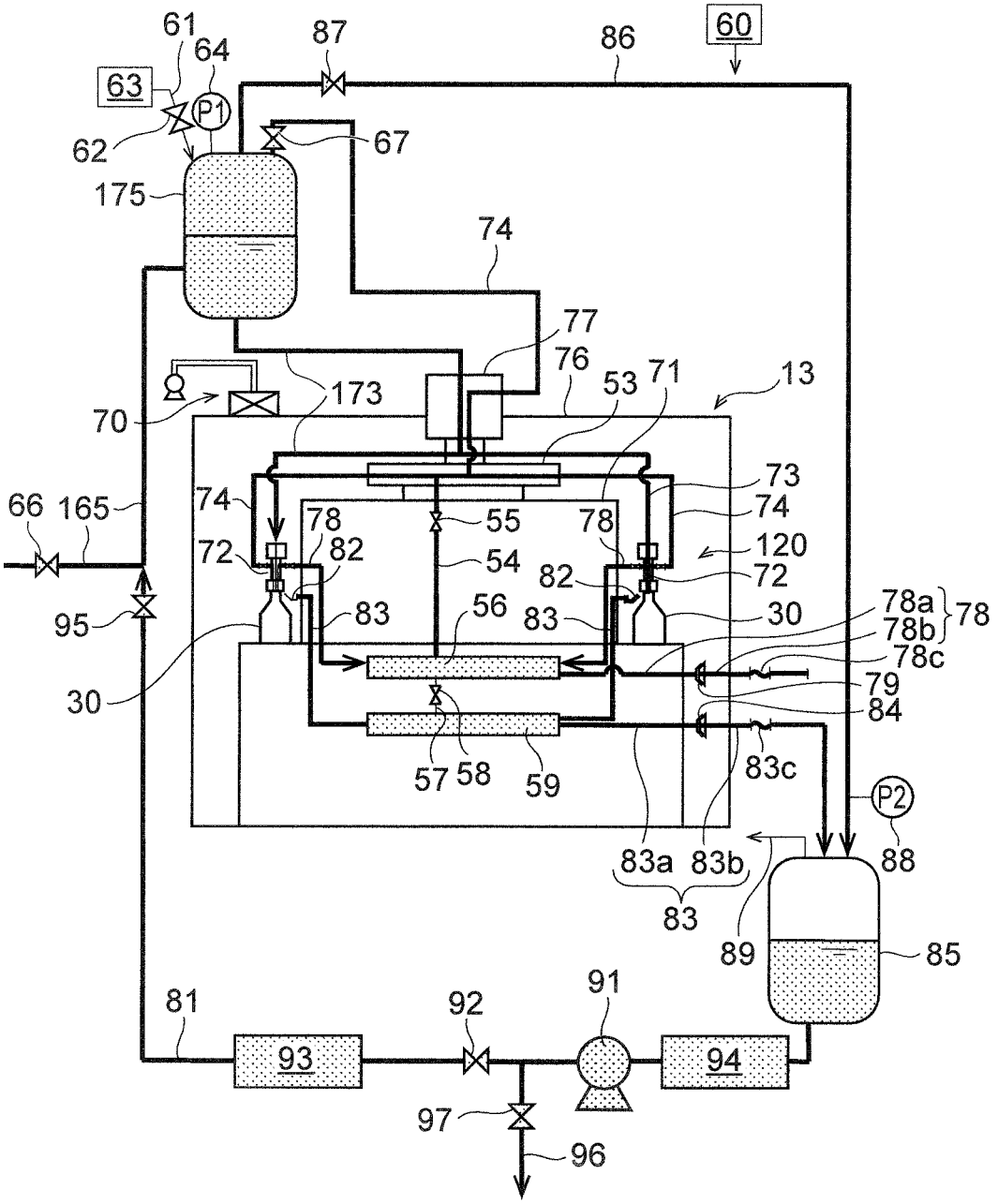
FIG. 7 is a schematic view showing a flow path to be CIP-cleaned after filling a carbonated beverage in a beverage filling part and in its periphery.
Figure 8:
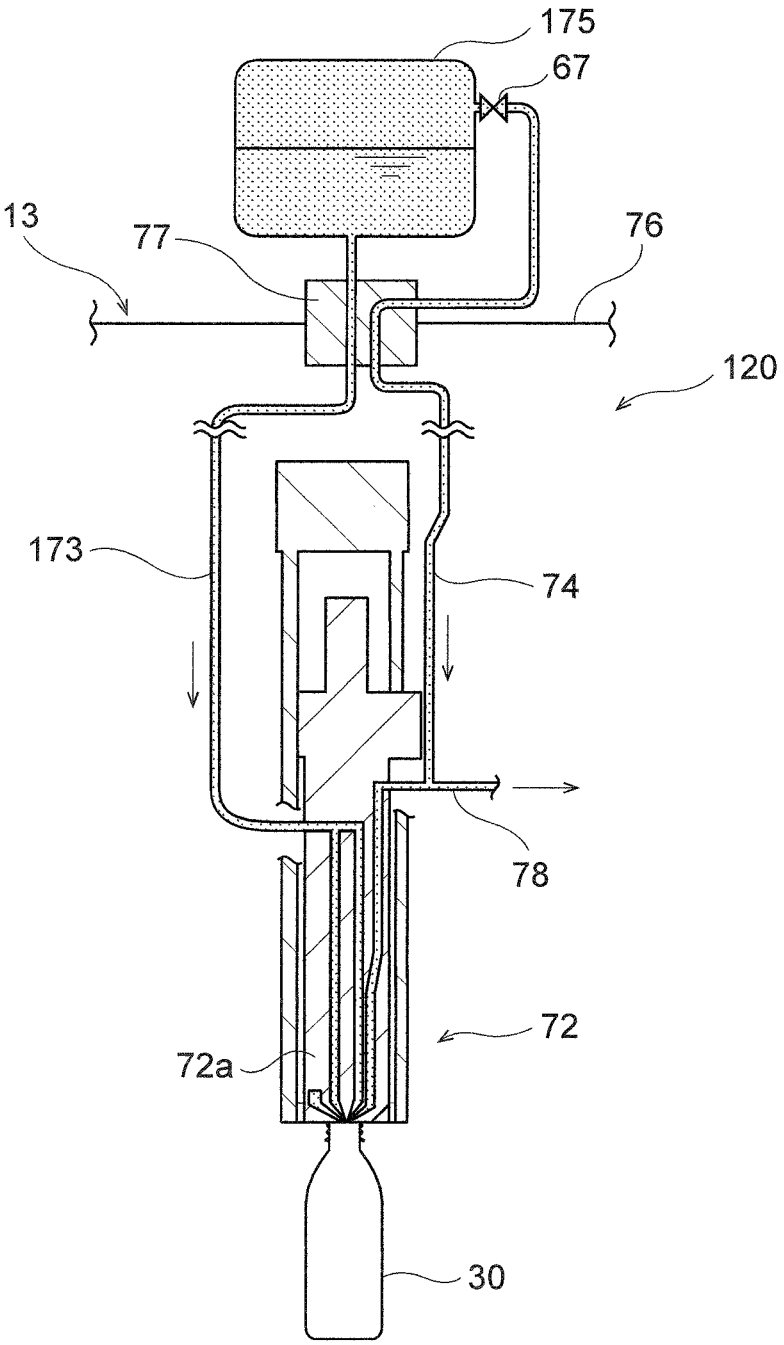
FIG. 8 is a schematic sectional view showing a flow path to be CIP-cleaned after filling a carbonated beverage in a filling nozzle.

Namely, as shown in FIGS. 7 and 8, an alkaline cleaning fluid is allowed to flow in from e.g. the beverage introduction pipe 165 and is drained out from the fluid drainage pipe 96 via the beverage filling tank 175, the beverage supplying pipe 173, the filling nozzle 72, the CIP pipe 83, the discharging tank 85, and the CIP circulation pipe 81. The alkaline cleaning fluid is also allowed to flow from e.g. the beverage filling tank 175 and is drained out from the fluid drainage pipe 96 after circulation/cleaning for a predetermined time via the counter pressure pipe 74, the snift pipe 78, the CIP pipe 83, the discharging tank 85, and the CIP circulation pipe 81. Further, the alkaline cleaning fluid is allowed to flow from e.g. the beverage filling tank 175 and is drained out from the fluid drainage pipe 96 after the circulation/cleaning for a predetermined time via the carbon dioxide gas discharging pipe 86, the discharging tank 85, and the CIP circulation pipe 81. Similarly, other carbonated beverage exclusive flow paths and the carbonated/non-carbonated beverage flow paths are also cleaned by the alkaline cleaning fluid. As described above, the alkaline cleaning fluid is allowed to flow through all of the carbonated beverage exclusive flow path and the carbonated/non-carbonated beverage flow path, so that the alkaline cleaning is performed on the entirety of the carbonated beverage exclusive flow path and the carbonated/non-carbonated beverage flow path.

Next, similarly, the acidic cleaning fluid is allowed to flow through all of the carbonated beverage exclusive flow path and the carbonated/non-carbonated beverage flow path, so that the acid cleaning is performed on the entirety of the carbonated beverage exclusive flow path and the carbonated/non-carbonated beverage flow path. After this, aseptic water is allowed to flow through all of the carbonated beverage exclusive flow path and the carbonated/non-carbonated beverage flow path, so that the entirety of the carbonated beverage exclusive flow path and the carbonated/non-carbonated beverage flow path are rinsed. In this manner, the residues, etc. of the previous beverage adhering to the interior of the flow path, through which the beverage passes, are removed. In FIGS. 7 and 8, the carbonated beverage exclusive flow path and the carbonated/non-carbonated beverage flow path, which are to be CIP-cleaned, are shown by bold lines and shading. The order of using the acidic cleaning fluid and the alkaline cleaning fluid may be appropriately determined based on detergency. For example, it is also possible that the acid cleaning is initially performed and thereafter the alkaline cleaning is performed.

CIP Processing Method After Filling Non-Carbonated Beverage

Meanwhile, if the beverage filled into the bottle 30 immediately before the CIP processing is a non-carbonated beverage, the control part 60 performs the CIP cleaning on only the flow path used for filling the non-carbonated beverage, through which the beverage passes. Concretely, a cleaning fluid obtained by adding the alkaline agent such as caustic soda to water is allowed to flow through only the carbonated/non-carbonated beverage flow path. After this, the cleaning fluid obtained by adding an acidic agent to water is allowed to flow through the flow path. Meanwhile, the carbonated beverage exclusive flow path is closed beforehand by a valve, etc. where the CIP cleaning is not performed.

Figure 9:
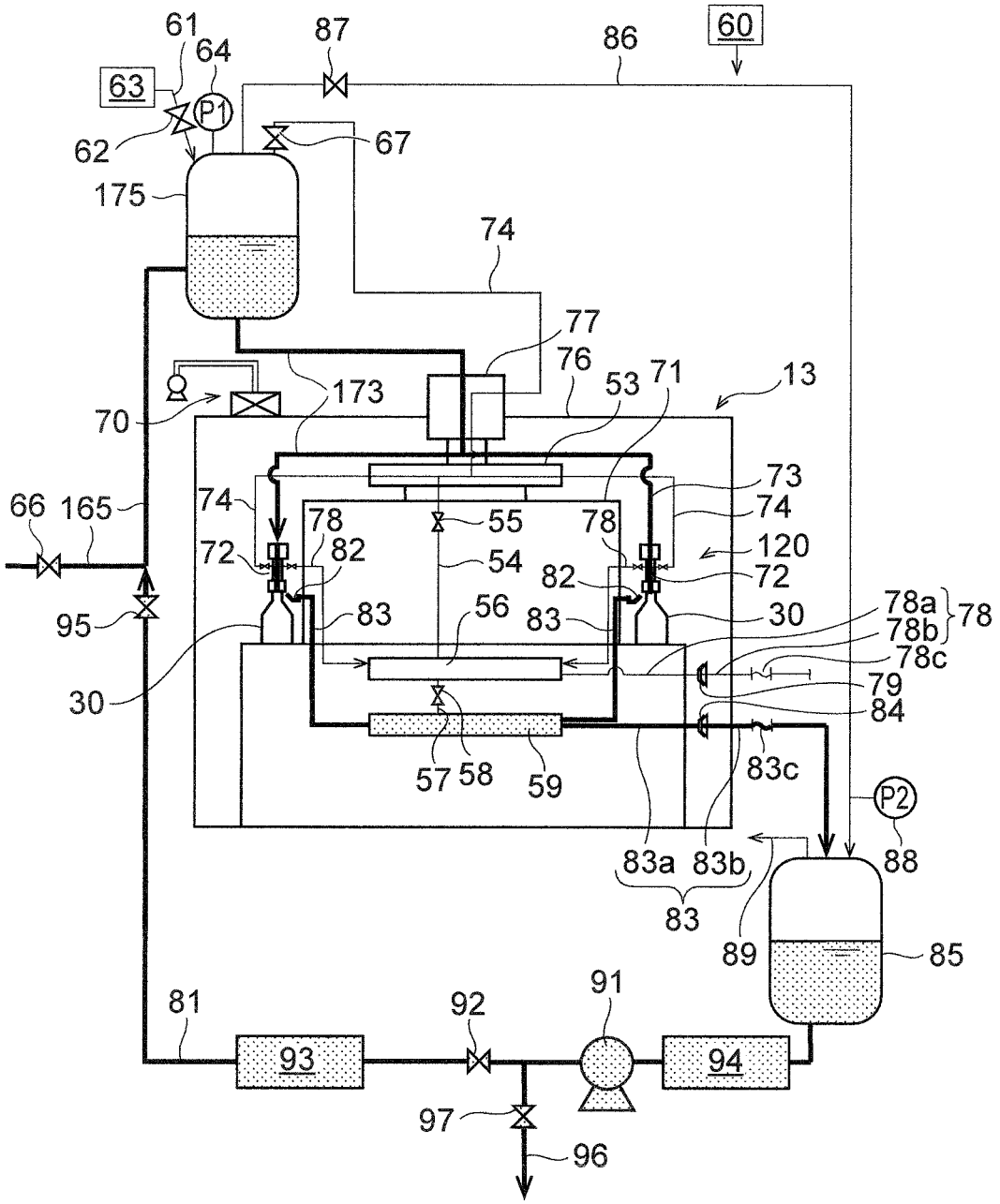
FIG. 9 is a schematic view showing a flow path to be CIP-cleaned after filling a non-carbonated beverage in a beverage filling part and in its periphery.
Figure 10:
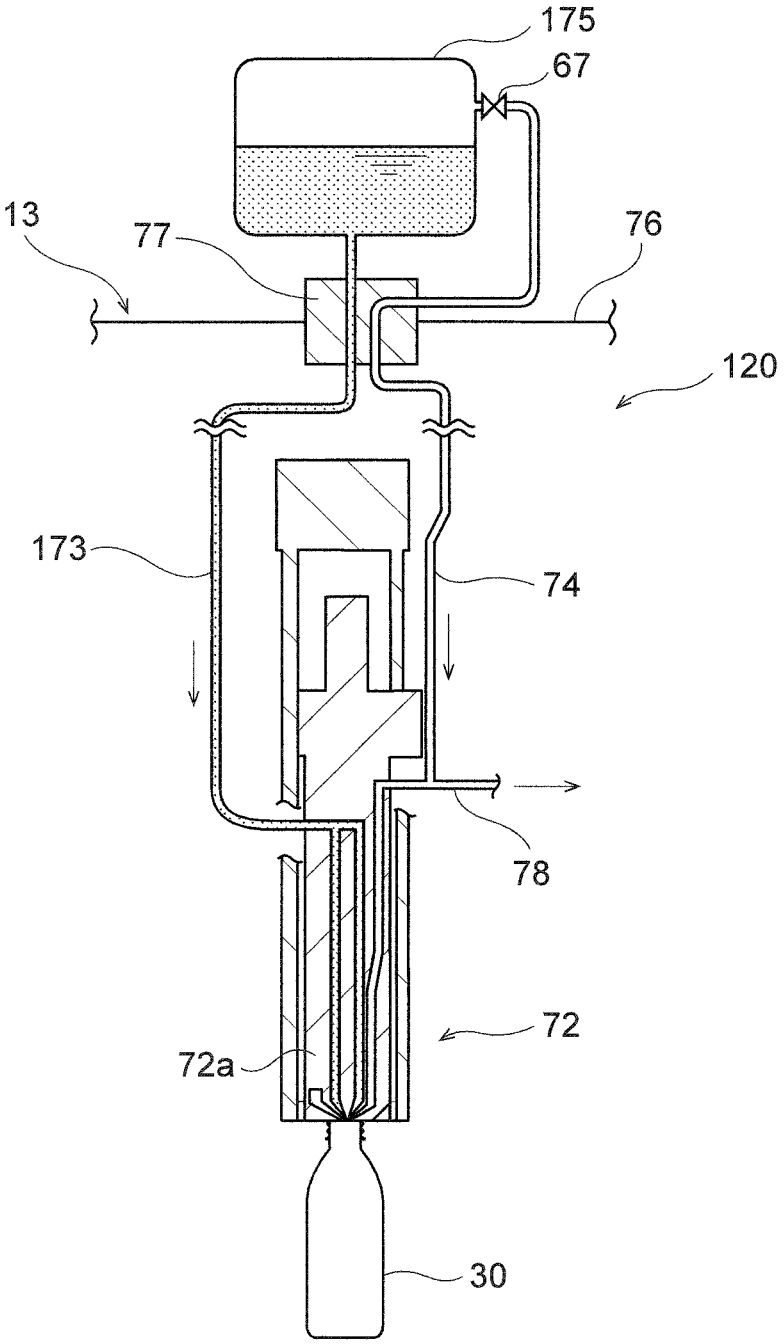
FIG. 10 is a schematic sectional view showing a flow path to be CIP-cleaned after filling a non-carbonated beverage in a filling nozzle.

Namely, as shown in FIGS. 9 and 10, an alkaline cleaning fluid is allowed to flow in from e.g. the beverage introduction pipe 165 and is drained out from the fluid drainage pipe 96 via the beverage filling tank 175, the beverage supplying pipe 173, the filling nozzle 72, the CIP pipe 83, the discharging tank 85, and the CIP circulation pipe 81. Similarly, other carbonated/non-carbonated beverage flow paths are also cleaned by the alkaline cleaning fluid. As described above, the alkaline cleaning fluid is allowed to flow through only the carbonated/non-carbonated beverage flow path, so that the alkaline cleaning is performed on only the carbonated/non-carbonated beverage flow path.

Next, similarly, the acidic cleaning fluid is allowed to flow through only the carbonated/non-carbonated beverage flow path, so that the acid cleaning is performed on only the carbonated/non-carbonated beverage flow path. After this, water is allowed to flow through only the carbonated/non-carbonated beverage flow path, so that the carbonated/non-carbonated beverage flow path is rinsed. In this manner, residues, etc. of the previous beverage adhering to the interior of the flow path, through which the beverage passes, are removed. In FIGS. 9 and 10, the carbonated/non-carbonated beverage flow path, which is to be CIP-cleaned, is shown by bold lines and shading. While the carbonated/non-carbonated beverage flow path is rinsed, the counter gas valve 67 and the valve, etc. in the snift pipe 78 may be intermittently opened and closed for 2 to 10 seconds per minute, thereby cleaning locations such as an O-ring and a valve seat of the valve, etc. that may contact with the beverage.

SIP Processing Method

Next, the SIP (sterilizing in place) processing is performed in the beverage aseptic filling system 110. The SIP processing is a processing for sterilizing in advance the interior of the flow path through which the beverage passes, before the filling work of the beverage is started and is performed by for example letting heated steam or hot water flow through the interior of the flow path that has been cleaned in accordance with the above CIP cleaning. In this manner, the interior of the flow path through which the beverage passes, is sterilized and put in an aseptic state.

In the present embodiment, irrespective of whether the beverage filled into the bottle 30 immediately before the CIP processing is a carbonated beverage or non-carbonated beverage, the SIP processing is performed on all of the carbonated beverage exclusive flow path and the carbonated/non-carbonated beverage flow path.

Namely, if the beverage filled into the bottle 30 immediately before the CIP processing is a carbonated beverage, the SIP processing is performed as is on both the carbonated beverage exclusive flow path and the carbonated/non-carbonated beverage flow path having been CIP-processed. Meanwhile, if the beverage filled into the bottle 30 immediately before the CIP processing is a non-carbonated beverage, the carbonated beverage exclusive flow path is opened after the CIP processing and the SIP processing is performed on not only the carbonated/non-carbonated beverage flow path but also the carbonated beverage exclusive flow path. In this manner, all the flow paths are sterilized irrespective of whether the beverage filled into the bottle 30 immediately before the CIP processing is a carbonated beverage or non-carbonated beverage, and therefore the entire beverage aseptic filling system 110 can be sterilized without fail. Further, it takes a shorter time to perform the SIP processing than to perform the CIP processing and therefore, even if the SIP is performed on all of the carbonated beverage exclusive flow path and the carbonated/non-carbonated beverage flow path, the productivity is not greatly lowered. Additionally, the control part 60 lets steam flow through the carbonated beverage exclusive flow path, thereby simultaneously sterilizing and cleaning the valve, etc. in the fluid-contacting portions of the carbonated/non-carbonated beverage flow path. Namely, if the SIP processing is performed with steam, then steam of at least 100° C., preferably at least 121.1° C. is allowed to flow, so that a product fluid oozing in packings, gaskets, and valve seats of the valves can be simultaneously sterilized and cleaned by using initially generated high-temperature condensed water. Particularly, if the material of the valve seat is Teflon-based, the cleaning effect by the SIP processing is high and it is not necessary to proactively clean the product fluid slightly adhering to a gap of the valve seat by means of the CIP.

Namely, for example, after the CIP processing, hot water is allowed to flow in from the beverage introduction pipe 165 and is drained out from the fluid drainage pipe 96 via the beverage filling tank 175, the beverage supplying pipe 173, the filling nozzle 72, the CIP pipe 83, the discharging tank 85, and the CIP circulation pipe 81. In this manner, the interiors of these paths are sterilized and, after this, aseptic water or aseptic air is allowed to flow through these paths, so that they are cooled, thereby performing the SIP processing.

Meanwhile, steam is allowed to flow out from the beverage filling tank 175 through the counter pressure pipe 74, the snift pipe 78, and the CIP pipe 83. Further, steam is allowed to flow out from the fluid drainage pipe 96 via e.g. the beverage filling tank 175, the carbon dioxide gas discharging pipe 86, the discharging tank 85, and the CIP circulation pipe 81. In this manner, the interiors of these paths are sterilized and, after this, cooling air and aseptic water are allowed to successively pass through these paths, so that they are cooled, thereby completing the SIP processing.

As described above, according to the present embodiment, if the beverage filled into the bottle 30 immediately before the CIP cleaning is a carbonated beverage, the CIP cleaning is performed on both the carbonated beverage exclusive flow path and the carbonated/non-carbonated beverage flow path. Meanwhile, if the beverage filled into the bottle 30 immediately before the CIP cleaning is a non-carbonated beverage, the CIP cleaning is performed on only the carbonated/non-carbonated beverage flow path.

Generally, the CIP cleaning is performed in such a manner that the flow paths inside the beverage aseptic filling system 110 are divided into a plurality of routes and the CIP cleaning is individually performed on the respective routes. For example, a first rinsing process, an alkaline cleaning process, an acid cleaning process, and a second rinsing process are performed in this order on each of the plurality of routes. Therefore, it takes time to perform the CIP cleaning and this is likely to lower the productivity.

On the other hand, in the present embodiment, if the beverage filled into the bottle 30 immediately before the CIP cleaning is a non-carbonated beverage in particular, the CIP cleaning is performed on only the carbonated/non-carbonated beverage flow path. In this manner, the CIP processing time can be shortened in the beverage aseptic filling system 110 serving both carbonated and non-carbonated beverages. As a result, the productivity in the beverage aseptic filling system 110 can be improved and, at the same time, the energy used for the CIP cleaning can be reduced. Further, if the beverage filled into the bottle 30 immediately before the CIP cleaning is a non-carbonated beverage, the carbonated beverage exclusive flow path is not used for filling the non-carbonated beverage and therefore it is not necessary to CIP-clean the carbonated beverage exclusive flow path.

In the above description, the beverage filling system has been explained by referring to, as an example, the beverage aseptic filling system 110 using an aseptic filling system, while the above system is not limited to this case. The beverage filling system may be a beverage filling system using a hot filling system for filling beverage under a high temperature of from 55° C. to 95° C.

The plurality of components disclosed in the above embodiment and variations can also be appropriately combined if necessary. Alternatively, some of the components may also be deleted from all the components shown in the above embodiment and the variations.

The invention claimed is:

1. A carbonated beverage aseptic filling system comprising:

a filling nozzle for filling a carbonated beverage;

a carbonated beverage filling tank connected to the filling nozzle via a carbonated beverage supplying pipe and a counter pressure pipe;

a snift pipe connected to the filling nozzle; and an aseptic chamber enclosing the filling nozzle, at least part of the carbonated beverage supplying pipe, and at least part of the counter pressure pipe, wherein the carbonated beverage supplying pipe and the counter pressure pipe are attached to the aseptic chamber by a rotary joint, a discharging valve is provided in the snift pipe inside the aseptic chamber and gas from the snift pipe is discharged into the aseptic chamber, and the snift pipe has a rotation-type interior snift pipe being located inside the aseptic chamber and rotating together with the filling nozzle, and a non-rotation type exterior snift pipe extending outward from the aseptic chamber, and wherein the discharging valve is located between the interior snift pipe and the exterior snift pipe.

2. The carbonated beverage aseptic filling system according to claim 1, wherein the exterior shift pipe is stretchable.

3. The carbonated beverage aseptic filling system according to claim 1, wherein a carbon dioxide gas supplying pipe and a carbon dioxide gas discharging pipe are connected to the carbonated beverage filling tank, valves are respectively provided in the carbon dioxide gas supply pipe and the carbon dioxide gas discharging pipe, and the valves are each controlled by a control part, thereby controlling a pressure inside the carbonated beverage filling tank.

4. The carbonated beverage aseptic filling system according to claim 3, wherein the relation P1>P2 is established between the pressure P1 inside the carbonated beverage filling tank and the pressure P2 inside the carbon dioxide gas discharging pipe.

5. The carbonated beverage aseptic filling system according to claim 3, wherein the valves provided in the carbon dioxide gas supplying pipe and the carbon dioxide gas discharging pipe are respectively controlled, lest the pressure P1 inside the carbonated beverage filling tank should be 0.01 MPa or lower.

* * * * *